US009254904B2

(12) United States Patent
Minoura

(10) Patent No.: US 9,254,904 B2
(45) Date of Patent: Feb. 9, 2016

(54) VESSEL

(71) Applicant: YAMAHA HATSUDOKI KABUSHIKI KAISHA, Iwata-shi, Shizuoka (JP)

(72) Inventor: Minoru Minoura, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 14/306,283

(22) Filed: Jun. 17, 2014

(65) Prior Publication Data

US 2014/0378014 A1 Dec. 25, 2014

(30) Foreign Application Priority Data

Jun. 21, 2013 (JP) ..... 2013-130797

(51) Int. Cl.
*B63H 20/24* (2006.01)

(52) U.S. Cl.
CPC ..... *B63H 20/245* (2013.01)

(58) Field of Classification Search
CPC ..... B63H 20/245
USPC ..... 440/89 R
See application file for complete search history.

(56) References Cited

U.S. PATENT DOCUMENTS 3,177,836 A * 4/1965 Salamin ..... B63B 1/042 114/283
5,176,551 A * 1/1993 Blanchard ..... F02M 35/167 440/77
8,298,023 B2 * 10/2012 Daikoku ..... B63H 20/20 440/3
8,668,537 B2 * 3/2014 Daikoku ..... B63H 20/32 440/76
8,858,282 B2 * 10/2014 Lonnborg ..... F02M 35/16 440/77
9,051,041 B2 * 6/2015 Litjens ..... B63H 20/245
2011/0303142 A1 * 12/2011 Craze ..... B63B 17/02 114/361
2012/0325136 A1 * 12/2012 McGill, Jr. ..... B63B 1/08 114/56.1
2014/0378014 A1 * 12/2014 Minoura ..... B63H 20/245 440/89 R

* cited by examiner

*Primary Examiner* — Lars A Olson
*Assistant Examiner* — Jovon Hayes
(74) *Attorney, Agent, or Firm* — Keating and Bennett, LLP

(57) ABSTRACT

A vessel includes an outboard motor including an upstream exhaust port that emits exhaust, a hull including a rear portion on which the outboard motor is mounted, a cabin disposed above the hull, a downstream exhaust port disposed farther to a lateral side than the outboard motor, and an exhaust passage extending from the upstream exhaust port to the downstream exhaust port and guiding the exhaust from the upstream exhaust port to the downstream exhaust port. The cabin includes a windshield disposed in front of the outboard motor in a plan view. The height of the cabin from a rearmost end of the outboard motor is not less than ½ or about ½ of a horizontal distance in a front/rear direction from a rear end edge of the windshield to the rearmost end of the outboard motor.

16 Claims, 13 Drawing Sheets

VESSEL

BACKGROUND OF THE INVENTION

1. Field of the Invention

The present invention relates to a vessel that is propelled by an outboard motor.

2. Description of the Related Art

U.S. Patent Application Publication No. 2012/0325136 A1 discloses a vessel including an outboard motor housed in a motor compartment provided in a rear portion of a hull, an air intake portion supplying air from outside the hull into the motor compartment, and an idle exhaust system emitting exhaust from inside the motor compartment to outside the hull.

During idling of the outboard motor, most of the exhaust generated in the interior of the outboard motor is emitted into the atmosphere from an idle exhaust port opening above the water surface. With a vessel that includes a tall cabin disposed in front of the outboard motor, when there is an air current flowing rearward from the front of the vessel, a vortex flow flowing forward may be generated in a space at the rear of the cabin disposed above a deck. The idle exhaust (exhaust emitted from the idle exhaust port) may thus flow forward in reverse toward the cabin.

If the cabin has a structure in which air behind the cabin can be entrained into the interior of the cabin, the idle exhaust with a bad odor may enter and further stagnate in the cabin and vessel occupants in the cabin may consequently have uncomfortable feelings. Although this problem can be resolved by providing a door at a rear portion of the cabin to improve the sealing property of the cabin, the cost and trouble of mounting the door are required in this case.

SUMMARY OF THE INVENTION

In order to overcome the previously unrecognized and unsolved challenges described above, a preferred embodiment of the present invention provides a vessel including an outboard motor including an upstream exhaust port that emits exhaust, a hull including a rear portion on which the outboard motor is mounted, a cabin including a windshield disposed in front of the outboard motor in a plan view, the cabin being disposed above the hull and being configured such that its height from a rearmost end of the outboard motor is not less than ½ or about ½ of a horizontal distance in a front/rear direction from the rearmost end of the outboard motor to a rear end edge of the windshield, a downstream exhaust port disposed farther to a lateral side than the outboard motor, and an exhaust passage extending from the upstream exhaust port to the downstream exhaust port and guiding the exhaust from the upstream exhaust port to the downstream exhaust port.

With this arrangement, the exhaust emitted from the upstream exhaust port of the outboard motor is guided by the exhaust passage to the downstream exhaust port disposed farther to the lateral side than the outboard motor. The exhaust emitted from the outboard motor is thus discharged from the downstream exhaust port. The cabin having a high height is disposed in front of the outboard motor. An air current that flows rearward from the front of the vessel flows rearward along the windshield of the cabin, and flows farther rearward from the windshield. In this process, ambient air at the periphery of the outboard motor may flow in reverse toward the cabin. Therefore, by arranging the exhaust passage to laterally guide the exhaust emitted from the outboard motor, the downstream exhaust port that emits the exhaust to air is disposed outside a reverse flow region in which the reverse flow of the ambient atmosphere occurs. Inflow of the exhaust into the cabin is thus prevented and the comfort of the vessel occupants is improved.

The downstream exhaust port may be disposed farther to the lateral side than the windshield of the cabin.

With this arrangement, the downstream exhaust port is disposed farther to the lateral side than the windshield of the cabin, and the position in which the exhaust discharged from the outboard motor is emitted to the atmosphere (the position of the downstream exhaust port) is disposed farther to the lateral side away from the outboard motor. The position of emission of the exhaust to the atmosphere is thus disposed farther to the lateral side away from the reverse flow region. Therefore, even if the ambient air at the periphery of the outboard motor flows in reverse toward the cabin, the inflow of the exhaust into the cabin is prevented.

The vessel may further include an operator seat disposed in an interior of the cabin.

With this arrangement, the operator seat on which the operator sits is disposed in the interior of the cabin and the cabin defines at least a portion of a cockpit. The exhaust emitted from the upstream exhaust port of the outboard motor is guided by the exhaust passage to the downstream exhaust port disposed farther to the lateral side than the outboard motor and therefore even if the reverse flow of the ambient air occurs in a space at the rear of the cabin, the inflow of the exhaust into the cabin is prevented. The comfort of the operator is thus improved.

Another preferred embodiment of the present invention provides a vessel including an outboard motor, a body including a rear portion on which the outboard motor is mounted, a right downstream exhaust port disposed at a right side of a width direction center of the body, a left downstream exhaust port disposed at a left side of the width direction center of the body, and at least one exhaust passage extending from the outboard motor to each of the right downstream exhaust port and the left downstream exhaust port and guiding exhaust from the outboard motor to each of the right downstream exhaust port and the left downstream exhaust port.

With this arrangement, the at least one exhaust passage extends from the outboard motor to each of the right downstream exhaust port and the left downstream exhaust port. The exhaust emitted from the outboard motor is guided to each of the right downstream exhaust port and the left downstream exhaust port by the exhaust passage and is discharged from each of the right downstream exhaust port and the left downstream exhaust port. The right downstream exhaust port is disposed at the right side of the width direction center of the body and the left downstream exhaust port is disposed at the left side of the width direction center of the body. When an air current (crosswind) that flows rearwardly and laterally toward the vessel is generated, a reverse flow region that is biased to the right or the left with respect to the width direction center of the body may form. Therefore, by separating the right downstream exhaust port and the left downstream exhaust port in the right/left direction, it is prevented that both downstream exhaust ports are disposed inside the reverse flow region even when a crosswind flows. It is thus prevented that the exhaust, which is discharged from both downstream exhaust ports, flows to the upper side of the body and the degradation of comfort of the vessel occupants is prevented.

The at least one exhaust passage may include a collective passage connected to the outboard motor, a right branch passage extending from the collective passage to the right downstream exhaust port, and a left branch passage extending from the collective passage to the left downstream exhaust port.

With this arrangement, the at least one exhaust passage is provided with the collective passage connected to the outboard motor and the two branch passages (the right branch passage and the left branch passage) branching from the collective passage. The exhaust inside the outboard motor flows into the collective passage and the exhaust inside the collective passage flows into each of the right branch passage and the left branch passage. A portion of the exhaust passage is thus branched and therefore the exhaust emitted from a position in common (the upstream exhaust port of the outboard motor) is emitted from the right downstream exhaust port and the left downstream exhaust port that are separated in the right/left direction. It is thus prevented that the exhaust, which is discharged from both downstream exhaust ports, flows to the upper side of the body even when a crosswind flows.

Each of the right downstream exhaust port and the left downstream exhaust port may be disposed farther to the rear than a front end of the outboard motor. For example, the respective downstream exhaust ports may be disposed farther to the rear than a rearmost end of the outboard motor or may be disposed farther to the rear than the hull.

With this arrangement, each of the right downstream exhaust port and the left downstream exhaust port is disposed farther to the rear than the front end of the outboard motor and is disposed to the rear away from the front end of the outboard motor. The width (length in the right/left direction) of a reverse flow region, in which the reverse flow of the ambient air occurs, narrows as the rear end of the reverse flow region is approached. Therefore, by not only disposing the right downstream exhaust port and the left downstream exhaust port at the right side and the left side of the width direction center of the body but also disposing the right downstream exhaust port and the left downstream exhaust port farther to the rear, the position at which the exhaust is emitted to the atmosphere is disposed away from the reverse flow region. Reverse flow of the exhaust is thus prevented.

The body may include a platform disposed farther to the rear than the outboard motor. Each of the right downstream exhaust port and the left downstream exhaust port may be provided at the platform.

With this arrangement, the right downstream exhaust port and the left downstream exhaust port are provided at the platform disposed farther to the rear than the outboard motor and are disposed to the rear away from the outboard motor. The width (length in the right/left direction) of the reverse flow region, in which the reverse flow of the ambient air occurs, narrows as the rear end of the reverse flow region is approached. The reverse flow of the exhaust is thus prevented by disposing the right downstream exhaust port and the left downstream exhaust port to the rear away from the outboard motor. The comfort of the vessel occupants is thus improved.

The right downstream exhaust port and the left downstream exhaust port may be provided respectively at a right side surface and a left side surface of the body.

With this arrangement, the right downstream exhaust port and the left downstream exhaust port are provided respectively at the right side surface and the left side surface of the body and the distance between the right downstream exhaust port and the left downstream exhaust port in the right/left direction is widened. It is prevented that both downstream exhaust ports are disposed inside the reverse flow region even when a crosswind flows. Further, since the right downstream exhaust port and the left downstream exhaust port are disposed to the lateral sides away from the reverse flow region, it is thus prevented that one of the right downstream exhaust port and the left downstream exhaust port is disposed inside the reverse flow region. The reverse flow of exhaust is thus prevented effectively.

At least a portion of the exhaust passage may be defined by an exhaust hose, for example. The exhaust hose may be an integral tube extending from the upstream exhaust port to each of the right downstream exhaust port and the left downstream exhaust port or may include a plurality of tubes joints joining two or more of the plurality of tubes.

With this arrangement, the vessel is provided with the exhaust hose that defines at least a portion of the exhaust passage. The exhaust passage is thus configured more simply than when at least a portion of the exhaust passage is defined by the body. Further, the momentum of the exhaust is weakened as the exhaust flows through the interior of a long, narrow exhaust hose and exhaust noise is thus reduced. The comfort of the vessel occupants is thus improved further.

At least a portion of the exhaust passage may be defined by the body, for example.

With this arrangement, at least a portion of the exhaust passage is defined by the body. The strength of the exhaust passage is thus increased in comparison to the case where at least a portion of the exhaust passage is defined by an exhaust hose. The durability of the exhaust passage is thus improved. The frequency of maintenance of the exhaust passage and arrangements related thereto is thus reduced.

The vessel may further include a blower disposed inside the exhaust passage and delivering gas inside the exhaust passage to at least one of the right downstream exhaust port and the left downstream exhaust port.

With this arrangement, the gas inside the exhaust passage is delivered by the blower disposed inside the exhaust passage to at least one of the right downstream exhaust port and the left downstream exhaust port. The exhaust emitted into the exhaust passage from the outboard motor is thus delivered reliably to at least one of the right downstream exhaust port and the left downstream exhaust port and is emitted reliably from at least one of the right downstream exhaust port and the left downstream exhaust port. A larger amount of exhaust is thus emitted outside the reverse flow region.

Yet another preferred embodiment of the present invention provides a vessel including an outboard motor including an upstream exhaust port that emits exhaust, a body including a rear portion on which the outboard motor is mounted, a downstream exhaust port disposed farther to a lateral side than the outboard motor, and an exhaust hose arranged to guide the exhaust from the upstream exhaust port to the downstream exhaust port, extending in an upward attitude or a horizontal attitude from the upstream exhaust port to an uppermost position higher than the upstream exhaust port and the downstream exhaust port, and extending in a downward attitude or a horizontal attitude from the uppermost position to the downstream exhaust port, and guiding the exhaust from the upstream exhaust port to the downstream exhaust port.

With this arrangement, the exhaust hose extends from the upstream exhaust port of the outboard motor to the uppermost position higher than the upstream exhaust port and the downstream exhaust port. Respective portions of the exhaust hose from the upstream exhaust port to the uppermost position are maintained in the upward attitude (an attitude of being inclined so as to be positioned higher as the uppermost position is approached) or in the horizontal attitude. The exhaust and liquid components contained in the exhaust, that are discharged from the upstream exhaust port, rise with the discharged momentum to the uppermost position. Further, the exhaust hose extends from the uppermost position to the downstream exhaust port and respective portions of the exhaust hose from the uppermost position to the downstream exhaust port are maintained in the downward attitude (an attitude of being inclined so as to be positioned lower as the distance from the uppermost position increases) or in the horizontal attitude. The liquid inside the exhaust hose that has moved farther downstream from the uppermost position is guided to the downstream exhaust port by the inclination of the exhaust hose. Water inside the exhaust hose and ice generated by freezing of water inside the exhaust hose is thus prevented from clogging the interior of the exhaust hose.

The upstream exhaust port may extend upward toward the exterior of the outboard motor.

With this arrangement, the upstream exhaust port provided in the outboard motor extends upward toward the exterior of the outboard motor, and therefore the exhaust and the liquid components contained in the exhaust are discharged obliquely upward from the upstream exhaust port. The exhaust and liquid components discharged from the upstream exhaust port move with the discharged momentum to positions farther downstream than the uppermost position. The exhaust and the liquid components contained therein are thus made to arrive reliably at positions farther downstream than the uppermost position. The clogging of the interior of the exhaust hose by water or ice is thus prevented.

The exhaust hose may extend from the upstream exhaust port to a fold-back position farther to the front than the upstream exhaust port and the downstream exhaust port and extend rearward from the fold-back position to the downstream exhaust port.

With this arrangement, the exhaust hose extends along a course passing through the upstream exhaust port provided in the outboard motor, the fold-back position farther to the front than the upstream exhaust port and the downstream exhaust port, and the downstream exhaust port disposed farther to the lateral side than the outboard motor, in that order. The exhaust hose is thus longer than when the exhaust hose extends along a rectilinear course joining the upstream exhaust port and the downstream exhaust port. The momentum of the exhaust weakens as it flows through the long, narrow hose. If the exhaust hose is long, the time during which the exhaust flows through the exhaust hose increases. The momentum of the exhaust is thus weakened further and the exhaust noise is reduced. The comfort of the vessel occupants is thus improved.

The outboard motor may be mounted on the rear portion of the body so as to be rotatable around a pivot axis extending horizontally in the width direction of the body at a position farther to the front than the upstream exhaust port and the downstream exhaust port. The exhaust hose may extend from the upstream exhaust port to a vicinity of the pivot axis and extend from the vicinity of the pivot axis to the downstream exhaust port.

With this arrangement, the exhaust hose extends from the upstream exhaust port to the vicinity of the pivot axis and extends from the vicinity of the pivot axis to the downstream exhaust port. The exhaust hose passes through the vicinity of the pivot axis. Even when the outboard motor is tilted up or down or is steered, the position of the pivot axis with respect to the body does not change. Respective portions of the exhaust hose are thus disposed so as have small movement amounts when the outboard motor is tilted up or down or is steered. The exhaust hose is thus prevented from twisting or tangling during a tilt operation of the outboard motor or during a steering operation of the outboard motor.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
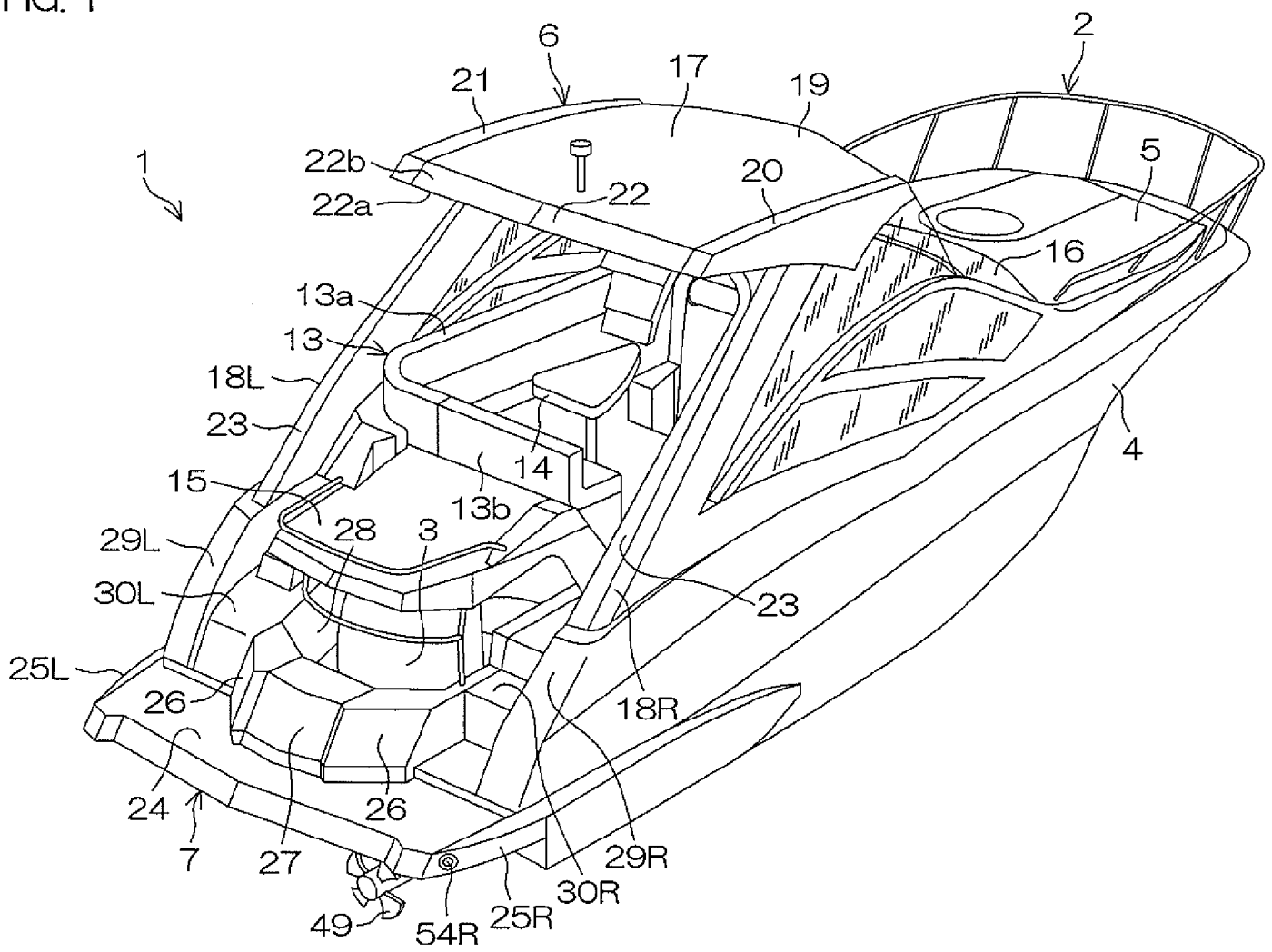
FIG. 1 is a perspective view of a vessel according to a preferred embodiment of the present invention as viewed from obliquely rearward and the right.
Figure 2:
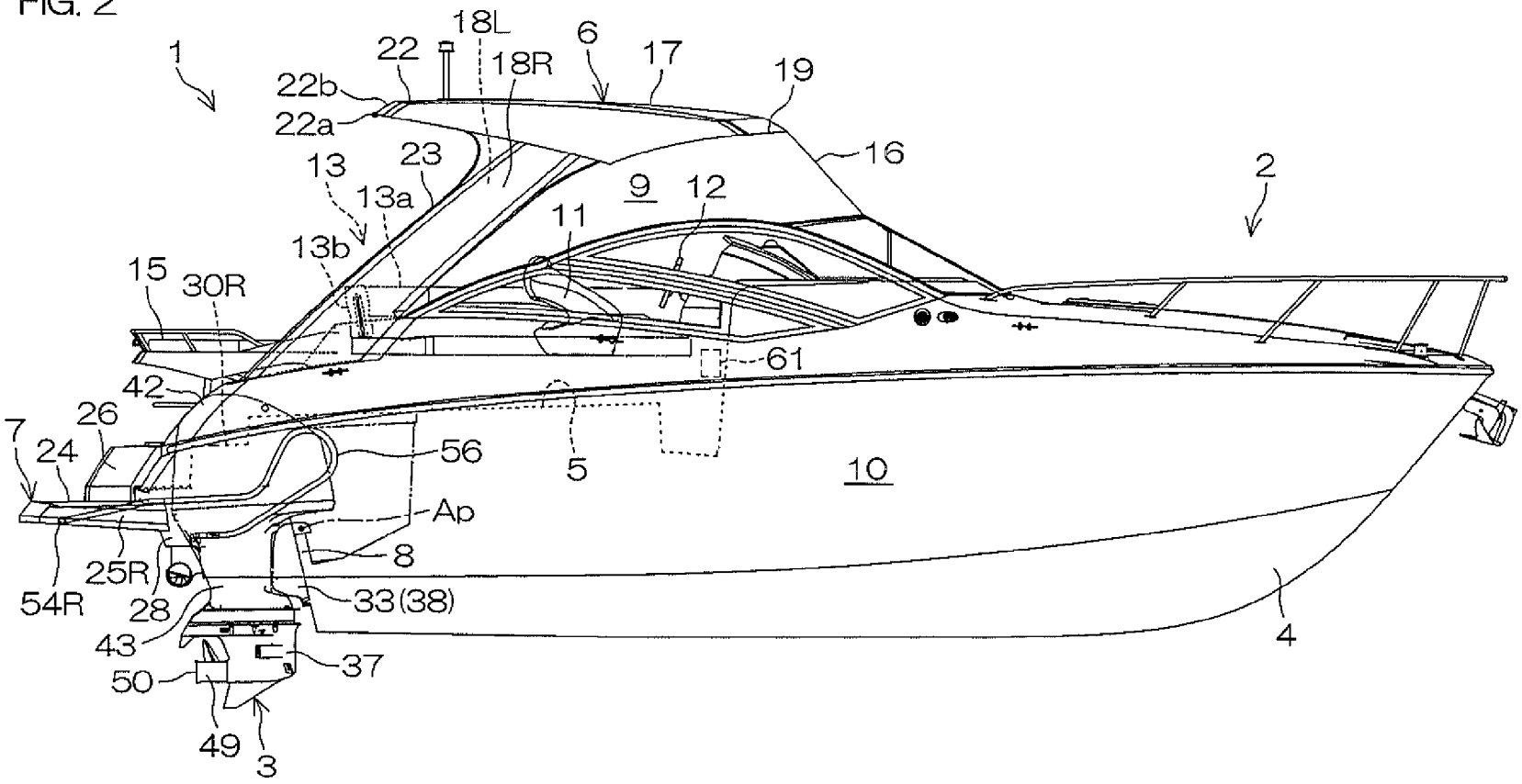
FIG. 2 is a transparent view of the vessel as viewed from the right.
Figure 3:
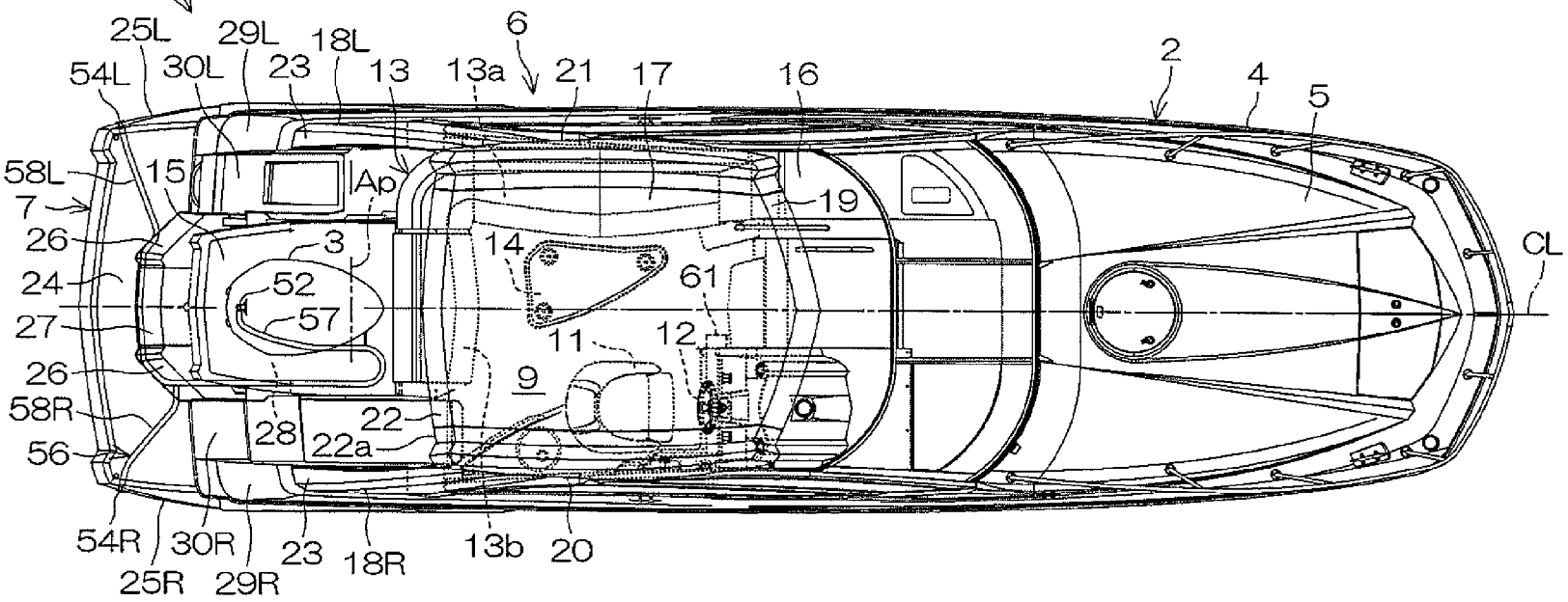
FIG. 3 is a transparent view of the vessel as viewed from above.
Figure 4:
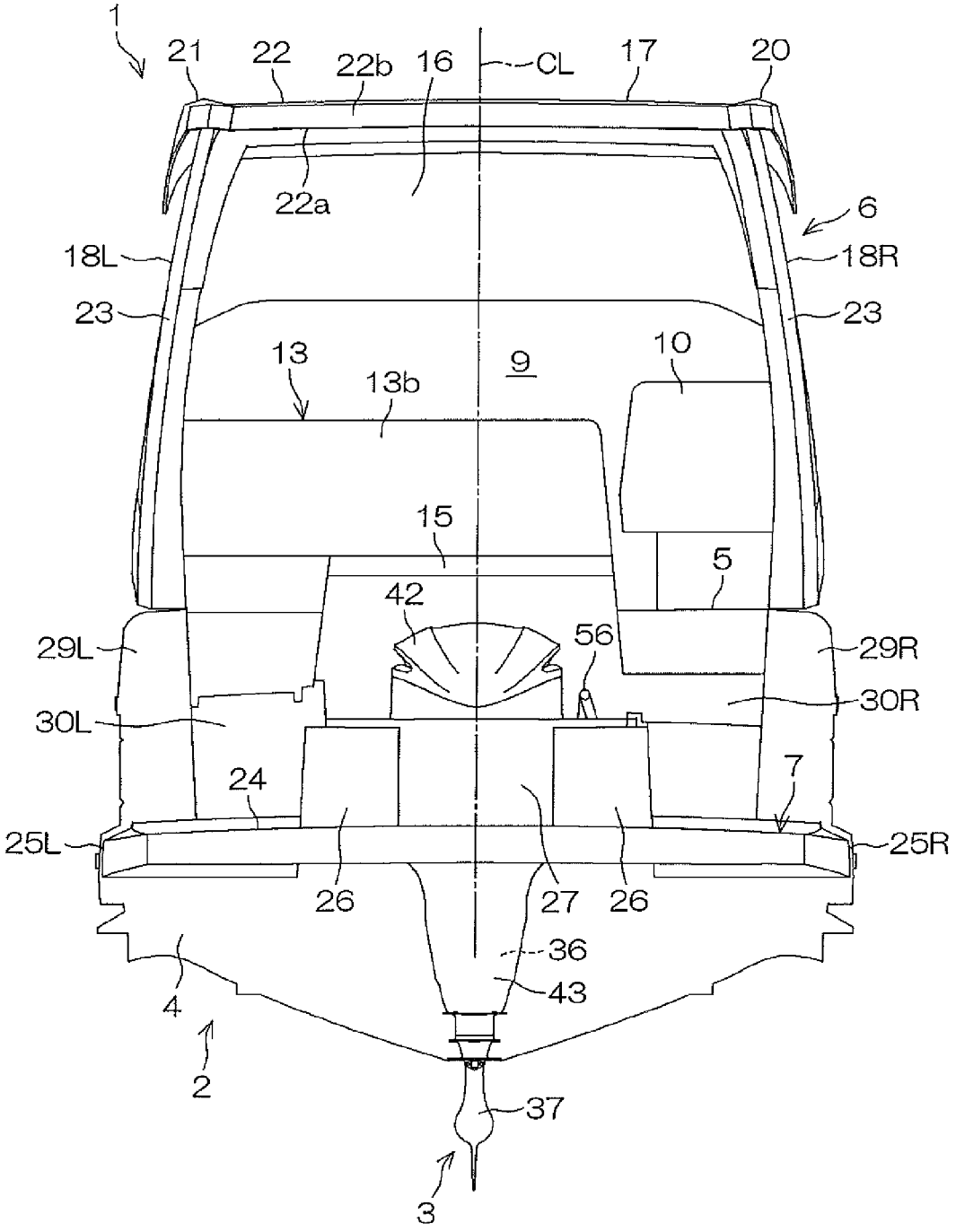
FIG. 4 is a schematic view of the vessel as viewed from the rear.

FIG. 1 is a perspective view of a vessel 1 according to a preferred embodiment of the present invention as viewed from obliquely rearward and the right. FIG. 2 is a transparent view of the vessel 1 as viewed from the right. FIG. 3 is a transparent view of the vessel 1 as viewed from above. FIG. 4 is a schematic view of the vessel 1 as viewed from the rear.

As shown in FIG. 1, the vessel 1 includes a body 2 that floats on a water surface and an outboard motor 3 that propels the body 2. The body 2 includes a hull 4 that floats on the water surface, a deck 5 disposed above the hull 4, a cabin 6 disposed above the deck 5, and a platform 7 extending rearward from the hull 4.

As shown in FIG. 2, the outboard motor 3 is mounted on a transom 8 provided at a rear portion of the hull 4. As shown in FIG. 3, the outboard motor 3 is disposed at a position overlapping with a width direction center CL (vertical plane passing through width direction centers of the stem and the stern) of the body 2 in a plan view. The platform 7 is disposed to the rear of the outboard motor 3. As shown in FIG. 2, the cabin 6 is disposed higher than the platform 7. The cabin 6 and the deck 5 define an upper riding compartment 9 that is closed at the front, right, left, and upper sides and open at the rear side.

Also, the hull 4 and the deck 5 define a lower riding compartment 10, in which a vessel occupant stays, at a level between the hull 4 and the deck 5 in the up/down direction. That is, the lower riding compartment 10 is provided in the interior of the body 2.

The vessel 1 includes a plurality of electrical devices disposed in the body 2 and a battery supplying power to the outboard motor 3 and the plurality of electrical devices. The battery is charged by the outboard motor 3 and disposed inside the body 2. The outboard motor 3 and the plurality of electrical devices are connected to the battery. The plurality of electrical devices include at least one of an illuminating device, an air conditioner, an audio device, and a refrigerator. For example, when one or more electrical devices are used in a state in which the vessel 1 is stopped on water, the electrical devices are driven by the battery and the battery is charged by the idling outboard motor 3.

As shown in FIG. 3, the vessel 1 includes an operator seat 11 on which an operator sits, a steering handle 12 operated by the operator to steer the vessel 1, and an output adjustment unit operated by the operator to adjust the output of the outboard motor 3 and switch between forward drive and reverse drive of the vessel 1. The vessel 1 preferably further includes a couch 13 that preferably is L-shaped or substantially L-shaped in a plan view, a table 14 disposed at the front and right of the couch 13, and a bed 15 disposed at the rear of the couch 13, for example.

As shown in FIG. 3, the operator seat 11, the handle 12, the output adjustment unit, the couch 13, the table 14, and the bed 15 are disposed inside the cabin 6 and overlap with a cabin upper wall 17 in a plan view. The operator seat 11, the couch 13, and the table 14 are disposed on the deck 5. The couch 13 includes a side seat 13*a* extending in the front/rear direction at the left side of the operator seat 11 and a rear seat 13*b* extending rightward from a rear end portion of the side seat 13*a*. The table 14 is disposed at a location in the right/left direction (corresponding to the width direction of the vessel 1) between the operator seat 11 and the side seat 13*a* at the front of the rear seat 13*b*. A portion of the rear seat 13*b* projects rearward from the cabin upper wall 17 in a plan view and is disposed at the rear of the cabin upper wall 17 in a plan view. The bed 15 is disposed at the rear of the rear seat 13*b*. The bed 15 is disposed above the outboard motor 3 and overlaps with the outboard motor 3 in a plan view.

As shown in FIG. 2, the cabin 6 includes a cabin front wall 16 extending obliquely upward toward the rear in a side view, the cabin upper wall 17 extending rearward from an upper end of the cabin front wall 16, and a right cabin side wall 18R and a left cabin side wall 18L respectively extending rearward from a right end and a left end of the cabin front wall 16. The cabin front wall 16 and the cabin upper wall 17 are examples of a windshield that shield air currents from the front.

As shown in FIG. 2, the cabin front wall 16 is disposed in front of the operator seat 11 and the handle 12. The cabin front wall 16 preferably has a U-shaped or substantially U-shaped horizontal section that opens rearwardly. The cabin upper wall 17 defining a roof portion of the cabin 6 is disposed above the operator seat 11 and the handle 12. The cabin front wall 16 extends downward from the cabin upper wall 17 to a position farther to the front than the cabin upper wall 17. The right cabin side wall 18R and the left cabin side wall 18L are respectively disposed at the right and left of the operator seat 11 and the handle 12. A portion of each of the cabin front wall 16, the right cabin side wall 18R, and the left cabin side wall 18L is preferably made of a transparent material. The transparent portions of the cabin 6 are disposed in front and to the right and left of the operator seat 11.

As shown in FIG. 3, the cabin upper wall 17 preferably has a rectangular or substantially rectangular shape in a plan view. The cabin upper wall 17 is disposed in front of the outboard motor 3 and the bed 15 in a plan view. The cabin upper wall 17 includes an upper wall front end portion 19 preferably having a V-shaped or substantially V-shaped configuration which opens rearwardly in a plan view, an upper wall right end portion 20 and an upper wall left end portion 21 respectively extending rearward from a right end and a left end of the upper wall front end portion 19, and an upper wall rear end portion 22 extending from a rear end of the upper wall right end portion 20 to a rear end of the upper wall left end portion 21. The upper wall rear end portion 22 includes an upper wall rear end edge 22*a* extending from a right end of the cabin upper wall 17 to a left end of the cabin upper wall 17. As shown in FIG. 2, the upper wall rear end portion 22 also includes an upper wall back surface 22*b* extending obliquely upward toward the front from the upper wall rear end edge 22*a*.

As shown in FIG. 4, the right cabin side wall 18R and the left cabin side wall 18L respectively extend upward from a right side wall 29R and a left side wall 29L of the hull 4. The upper wall right end portion 20 is disposed to the right of an upper end portion of the right cabin side wall 18R. The upper wall left end portion 21 is disposed to the left of an upper end portion of the left cabin side wall 18L. As shown in FIG. 2, each of the right cabin side wall 18R and the left cabin side wall 18L includes a side wall rear end edge 23. A lower end portion of each side wall rear end edge 23 is disposed above the outboard motor 3 in a side view. A portion of each of the outboard motor 3 and the bed 15 is disposed farther to the rear than lower end portions of the right cabin side wall 18R and the left cabin side wall 18L. As shown in FIG. 3, the outboard motor 3 and the bed 15 are disposed between the lower end portions of the right cabin side wall 18R and the left cabin side wall 18L in a plan view.

As shown in FIG. 2, the side wall rear end edge 23 extends from a position farther to the rear than the upper wall rear end portion 22 to the upper wall right end portion 20 or the upper wall left end portion 21. Each side wall rear end edge 23 includes an inclined portion extending obliquely upward toward the front in a side view and a curved upper end portion connected to the cabin upper wall 17. Each side wall rear end edge 23 is connected to the cabin upper wall 17 at a position farther to the front than the upper wall rear end portion 22. A portion of the cabin upper wall 17 thus projects toward the rear from upper end portions of the side wall rear end edges 23.

As shown in FIG. 2, the platform 7 is disposed at the rear of the hull 4. The platform 7 is disposed higher than the height of the water surface during stoppage of the vessel 1. The platform 7 is used, for example, by a vessel occupant when the vessel occupant moves onboard the vessel 1 from the water and vice versa. The platform 7 is shorter in the front/rear direction than any of the hull 4, the cabin 6, and the bed 15. The platform 7 is disposed lower than the bed 15. A rear end portion of the platform 7 is disposed farther to the rear than the bed 15. As shown in FIG. 1, the width of the platform 7 is wider than the width of the bed 15. A front end portion of the platform 7 has a width equal or substantially equal to a rear portion of the hull 4.

As shown in FIG. 1, the platform 7 includes an upper surface 24 disposed along a horizontal plane above the water surface and having a rectangular or substantially rectangular shape in a plan view that extends in the right/left direction, a right side surface 25R and a left side surface 25L disposed lower than the upper surface 24 of the platform 7, a pair of right and left central walls 26 extending upward from a central portion in the right/left direction of the upper surface 24, and a hatch 27 for propeller inspection disposed between the pair of central walls 26.

As shown in FIG. 1, the upper surface 24 of the platform 7 extends from a right end portion of the platform 7 to a left end portion of the platform 7. The upper surface 24 of the platform 7 is longer in the right/left direction than the outboard motor 3 and the bed 15. The right side surface 25R and the left side surface 25L of the platform 7 are disposed farther to the lateral sides than the outboard motor 3 and the bed 15. The right side surface 25R and the left side surface 25L of the platform 7 respectively extend rearward from a right side surface and a left side surface of the hull 4. The right side surface of the hull 4 and the right side surface 25R of the platform 7 define a right side surface of the body 2 and the left side surface of the hull 4 and the left side surface 25L of the platform 7 define a left side surface of the body 2.

As shown in FIG. 1, the central walls 26 of the platform 7 are disposed below a rear end portion of the bed 15. The central walls 26 of the platform 7 and the rear end portion of the bed 15 face each other in the up/down direction across a space therebetween. The hatch 27 is mounted on the pair of central walls 26 so as to be able to rotate to the front and rear with respect to the pair of central walls 26 around a horizontal axis extending in the right/left direction. The hatch 27 is disposed at the rear of the outboard motor 3. The hatch 27 is disposed above and at the rear of the position of a propeller 49 when the outboard motor 3 is tilted up. When the hatch 27 is opened toward the rear in the state in which the outboard motor 3 is tilted up, the propeller 49 is exposed between the pair of central walls 26.

As shown in FIG. 1, the outboard motor 3 is disposed inside a recess 28 provided at a rear portion of the hull 4. The recess 28 of the hull 4 is rearwardly open in a plan view. The platform 7 is disposed at the rear of the recess 28 of the hull 4. The rear end of the recess 28 of the hull 4 is closed by the platform 7. Together with the recess 28 of the hull 4, the platform 7 defines a space that is closed at the front, right, left, and rear sides. Also, the deck 5 and the bed 15 define a space that is open at the right, left, and rear sides and closed at the front and upper sides. A portion of the outboard motor 3 is disposed at a position at which it is visible from the right, left, and rear of the space between the deck 5 and the bed 15.

As shown in FIG. 3, the outboard motor 3 and the bed 15 are disposed between the right side wall 29R and the left side wall 29L of the hull 4 in a plan view. The deck 5 includes a right deck rear portion 30R disposed between the bed 15 and the right side wall 29R of the hull 4 in a plan view and a left deck rear portion 30L disposed between the bed 15 and the left side wall 29L of the hull 4 in a plan view. As shown in FIG. 1, the right deck rear portion 30R and the left deck rear portion 30L are disposed lower than upper end portions of the right side wall 29R and the left side wall 29L of the hull 4. The right deck rear portion 30R and the left deck rear portion 30L extend forward from the upper surface 24 of the platform 7. The pair of central walls 26 of the platform 7 are disposed farther inward (in the direction toward the width direction center CL of the body 2) than the right deck rear portion 30R and the left deck rear portion 30L. The right deck rear portion 30R defines a stepped passage extending to the interior of the cabin 6 from the upper surface 24 of the platform 7.

Figure 5:
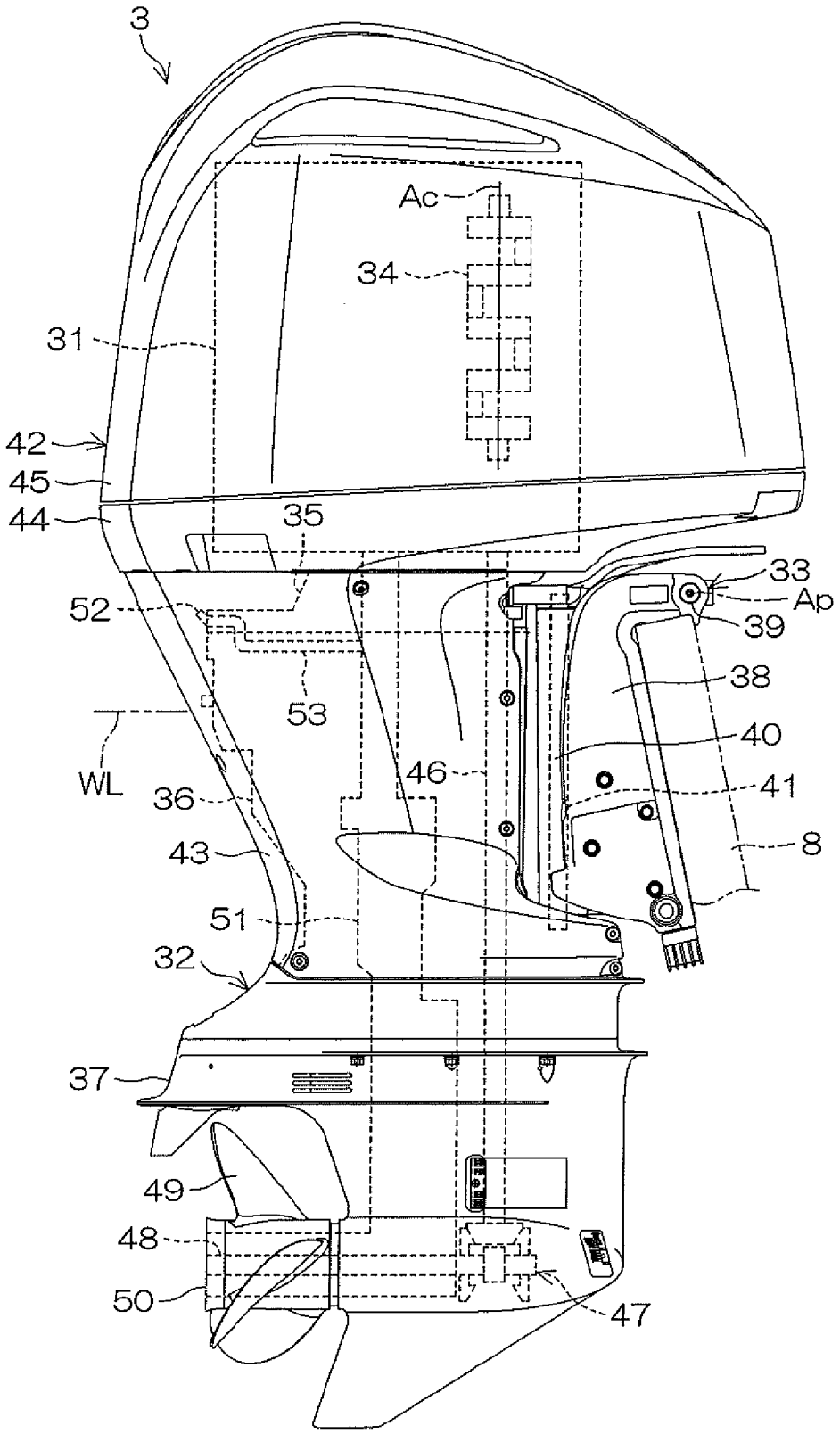
FIG. 5 is a right side view of an outboard motor according to a preferred embodiment of the present invention.
Figure 6:
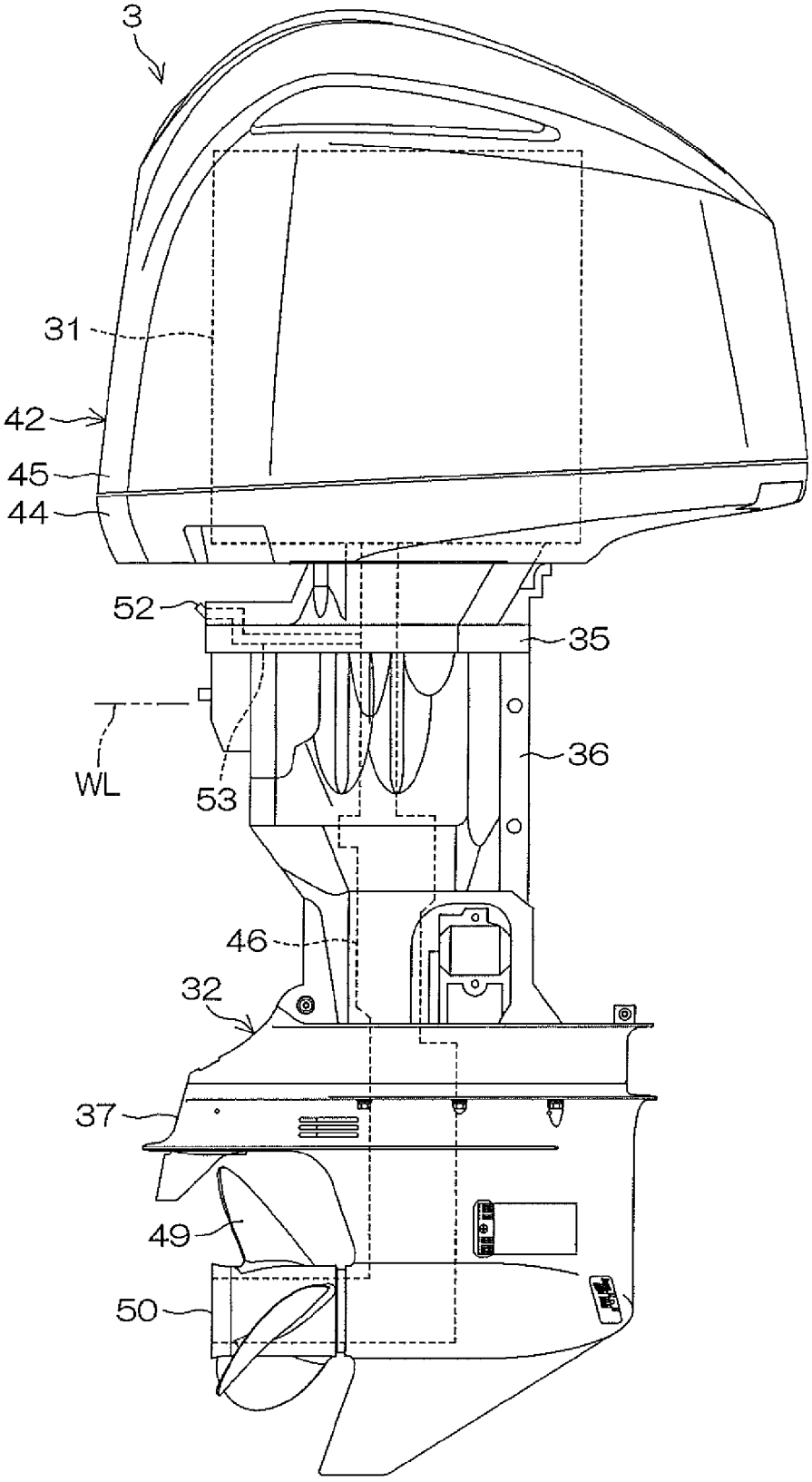
FIG. 6 is a right side view of the outboard motor in a state in which an apron and a suspension apparatus have been removed.

FIG. 5 is a right side view of the outboard motor 5 according to a preferred embodiment of the present invention. FIG. 6 is a right side view of the outboard motor 3 in a state in which an apron 43 and a suspension apparatus 33 have been removed.

As shown in FIG. 5, the outboard motor 3 includes an engine 31 generating motive power that rotates the propeller 49, a casing 32 supporting the engine 31, and the suspension apparatus 33 mounting the casing 32 on the transom 8.

As shown in FIG. 5, the engine 31 is an internal combustion engine that includes a crankshaft 34 rotatable around a vertical crank axis Ac. As shown in FIG. 6, the casing 32 is disposed below the engine 31. The casing 32 preferably is made of a metal, such as an aluminum alloy or steel, etc., for example. The casing 32 includes an exhaust guide 35 disposed below the engine 31, an upper case 36 disposed below the exhaust guide 35, and a lower case 37 disposed below the upper case 36. The engine 31 is supported by the exhaust guide 35. The upper case 36 is coupled to the exhaust guide 35 and the lower case 37 is coupled to the upper case 36.

As shown in FIG. 5, the suspension apparatus 33 includes a pair of right and left clamp brackets 38 mounted on the hull 4, a pivot shaft 39 supported by the pair of clamp brackets 38 in an attitude extending in the right/left direction, and a swivel bracket 40 mounted on the pivot shaft 39. The suspension apparatus 33 further includes a steering shaft 41 supported by the swivel bracket 40 in an attitude extending in the up/down direction.

The steering shaft 41 is rotatable to the right and left around a central axis (steering axis) of the steering shaft 41 with respect to the swivel bracket 40. The outboard motor main body that includes the engine 31 and the casing 32 rotates, together with the steering shaft 41, to the right and left around the steering axis. The outboard motor main body is thus rotatable to the right and left with respect to the hull 4. Also, the swivel bracket 40 is rotatable around a central axis (pivot axis Ap) of the pivot shaft 39 with respect to the clamp brackets 38 mounted on the hull 4. The outboard motor main body rotates, together with the swivel bracket 40 and the steering shaft 41, to the front and rear around the pivot axis Ap. The outboard motor main body is thus rotatable to the front and rear with respect to the hull 4.

As shown in FIG. 5, the outboard motor 3 includes an engine cover 42 covering the engine 31 and the apron 43 covering the casing 32.

As shown in FIG. 5, the engine cover 42 includes a bottom cover 44 disposed above the casing 32 and a top cover 45 disposed above the bottom cover 44. The bottom cover 44 is mounted on the exhaust guide 35 and the top cover 45 is mounted on the bottom cover 44 so as to be able to be opened and closed. At least a portion of each of the bottom cover 44 and the top cover 45 is made of resin or other material of lower strength than the casing 32. The bottom cover 44 has a cup-shaped configuration that opens upwardly, and the top cover 45 has a cup-shaped configuration that opens downwardly. The opening portion of the top cover 45 is vertically overlapped with the opening portion of the bottom cover 44 via a seal. A housing space housing the engine 31 is thus provided in the interior of the engine cover 42.

As shown in FIG. 5, the apron 43 is disposed lower than the engine cover 42. An upper end portion of the apron 43 is disposed along a lower surface of the engine cover 42. The apron 43 is disposed higher than the lower case 37. The apron 43 is thus disposed at a height between the engine cover 42 and the lower case 37. The apron 43 is disposed at a periphery of the upper case 36. An outer surface of the upper case 36, including side surfaces and a back surface, is covered by the apron 43. At least a portion of the apron 43 is made of resin or other material of lower strength than the casing 32. As with the engine cover 42, the apron 43 defines a portion of the outer surface of the outboard motor 3.

As shown in FIG. 5, the outboard motor 3 includes a driveshaft 46 extending downward from the engine 31, a forward/reverse drive switching mechanism 47 coupled to a lower end portion of the driveshaft 46, a propeller shaft 48 coupled to the forward/reverse drive switching mechanism 47, and a propeller 49 detachably mounted on the propeller shaft 48.

As shown in FIG. 5, the driveshaft 46, the forward/reverse drive switching mechanism 47, and the propeller shaft 48 are housed inside the casing 32. The driveshaft 46 and the propeller shaft 48 are rotatably supported by the casing 32. The driveshaft 46 extends in the up/down direction inside the casing 32. The propeller shaft 48 extends in the front/rear direction inside the lower case 37. A rear end portion of the propeller shaft 48 projects rearward from the lower case 37. The propeller 49 is mounted on the projecting portion (rear end portion) of the propeller shaft 48. The propeller 49 is thus disposed at the rear of the lower case 37. The propeller 49 rotates, together with the propeller shaft 48, around a central axis of the propeller shaft 48.

The propeller shaft 48 is capable of rotating in the forward rotation direction (clockwise direction in a rear view) and the reverse rotation direction (direction opposite to the forward rotation direction) with respect to the lower case 37. The driveshaft 46 is driven in a fixed rotation direction by the engine 31. By operation of the output adjustment unit, the forward/reverse drive switching mechanism 47 is switched among a forward drive state of transmitting rotation from the driveshaft 46 to the propeller shaft 48 so that the propeller shaft 48 rotates in the forward rotation direction, a reverse drive state of transmitting rotation from the driveshaft 46 to the propeller shaft 48 so that the propeller shaft 48 rotates in the reverse rotation direction, and a neutral state of interrupting the transmission of rotation from the driveshaft 46 to the propeller shaft 48. The rotation direction of the propeller 49 is thus switched to change the direction of thrust generated by the propeller 49.

As shown in FIG. 5, the outboard motor 3 includes a main exhaust passage 51 guiding the exhaust of the engine 31 to a main exhaust port 50 opening underwater and an idle exhaust passage 53 guiding the exhaust inside the main exhaust passage 51 to an upstream exhaust port 52 opening above the water surface WL.

As shown in FIG. 5, the main exhaust passage 51 extends downward from the engine 31. The driveshaft 46 and the forward/reverse drive switching mechanism 47 are disposed in front of the main exhaust passage 51. The main exhaust passage 51 extends downward from the engine 31 to the propeller shaft 48 and extends rearward along the propeller shaft 48. The main exhaust passage 51 is defined by the casing 32. The main exhaust passage 51 passes through the interiors of the exhaust guide 35, the upper case 36, and the lower case 37 and opens at a back surface (rear surface) of the lower case 37. The interior of the propeller 49 is connected to an end portion of the main exhaust passage 51 that opens at the back surface of the lower case 37. The main exhaust port 50 is defined by the propeller 49. The main exhaust passage 51 is thus connected to the main exhaust port 50 that opens rearward at a rear end portion of the propeller 49.

As shown in FIG. 5, the idle exhaust passage 53 is disposed lower than the engine 31. The idle exhaust passage 53 branches from the main exhaust passage 51 in the interior of the casing 32. The idle exhaust passage 53 is thus connected to the main exhaust passage 51. The idle exhaust passage 53 is defined by the casing 32. The upstream exhaust port 52 opens at the outer surface of the casing 32. FIG. 5 and FIG. 6 show an example where the upstream exhaust port 52 opens at an outer surface of the casing 32 and extends upward toward the exterior of the outboard motor 3. The upstream exhaust port 52 is disposed farther to the rear than the pivot shaft 39. The opening area of the upstream exhaust port 52 is narrower than the opening area of the main exhaust port 50. The upstream exhaust port 52 is connected to an exhaust hose 56 to be described below. The exhaust that flows from the main exhaust passage 51 to the idle exhaust passage 53 is emitted out of the outboard motor 3 upon passing through the interior of the exhaust hose 56.

The output of the engine 31 is changed by operation of the output adjustment unit. When the output of the engine 31 is high, water entering from the main exhaust port 50 into the main exhaust passage 51 is pushed out from the main exhaust port 50 by the exhaust emitted from the engine 31 into the main exhaust passage 51. The exhaust of the engine 31 is thus guided to the main exhaust port 50 by the main exhaust passage 51 and is emitted underwater from the main exhaust port 50 that corresponds to being the exit of the main exhaust passage 51. At the same time, a portion of the exhaust inside the main exhaust passage 51 is guided by the idle exhaust passage 53 to the upstream exhaust port 52 and is emitted to air via the exhaust hose 56 to be described below.

On the other hand, when the output of the engine 31 is low (for example, during idling), the flow rate of the exhaust emitted from the engine 31 into the main exhaust passage 51 is lower than that at a high output (when the output of the engine 31 is high), and the gas pressure inside the main exhaust passage 51 is lower than that at high output. The exhaust inside the main exhaust passage 51 is thus hardly emitted from the main exhaust port 50 but is mainly emitted into the exhaust hose 56 from the upstream exhaust port 52. Therefore, when the output of the engine 31 is low, most of the exhaust is emitted into the atmosphere. When the exhaust is emitted underwater from the main exhaust port 50, bubbles are formed underwater and a sound is emitted. When the output of the engine 31 is low, the exhaust is hardly emitted from the main exhaust port 50 and therefore the noise is reduced.

Figure 7:
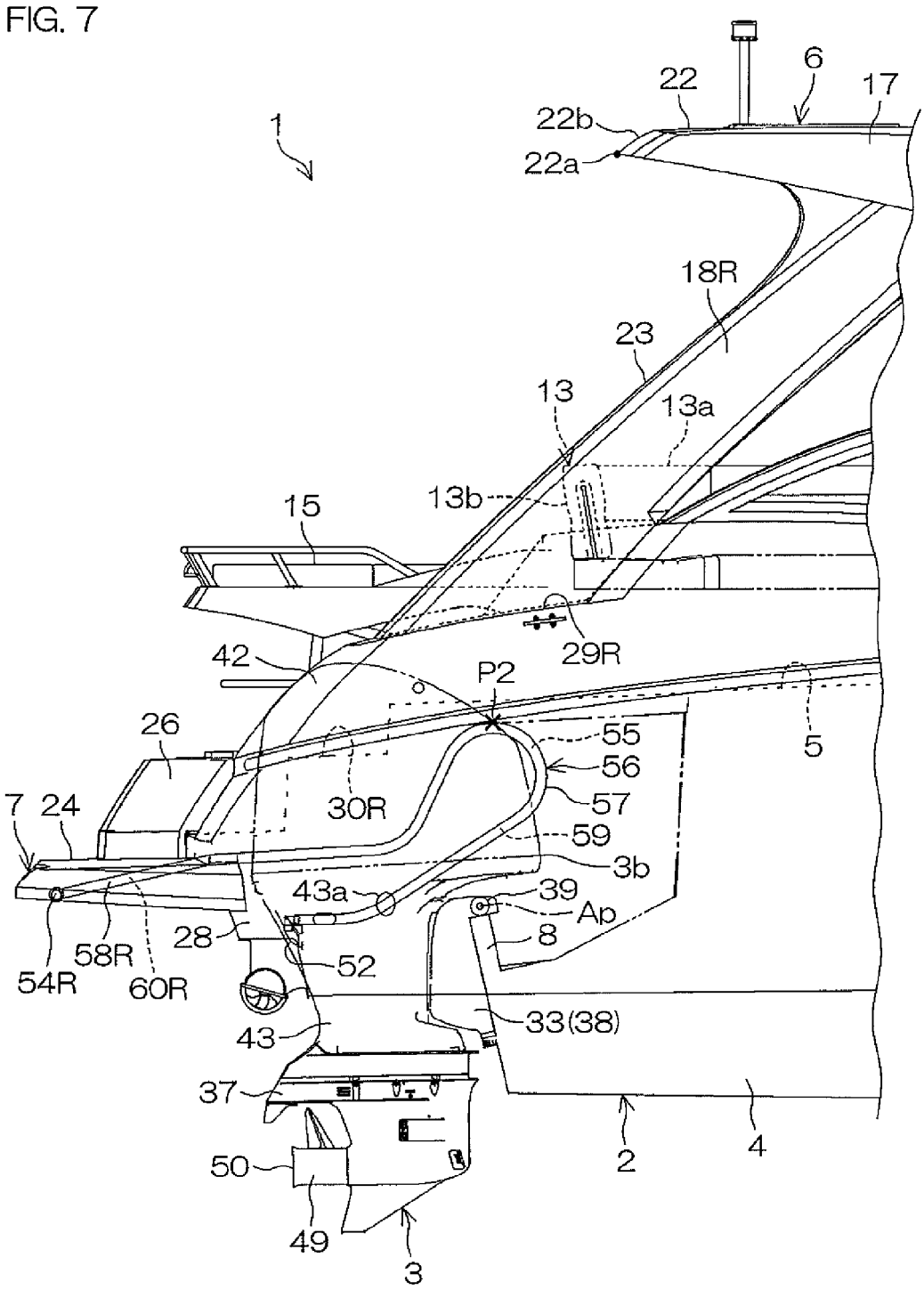
FIG. 7 is a transparent view of a rear portion of the vessel as viewed from the right.
Figure 8:
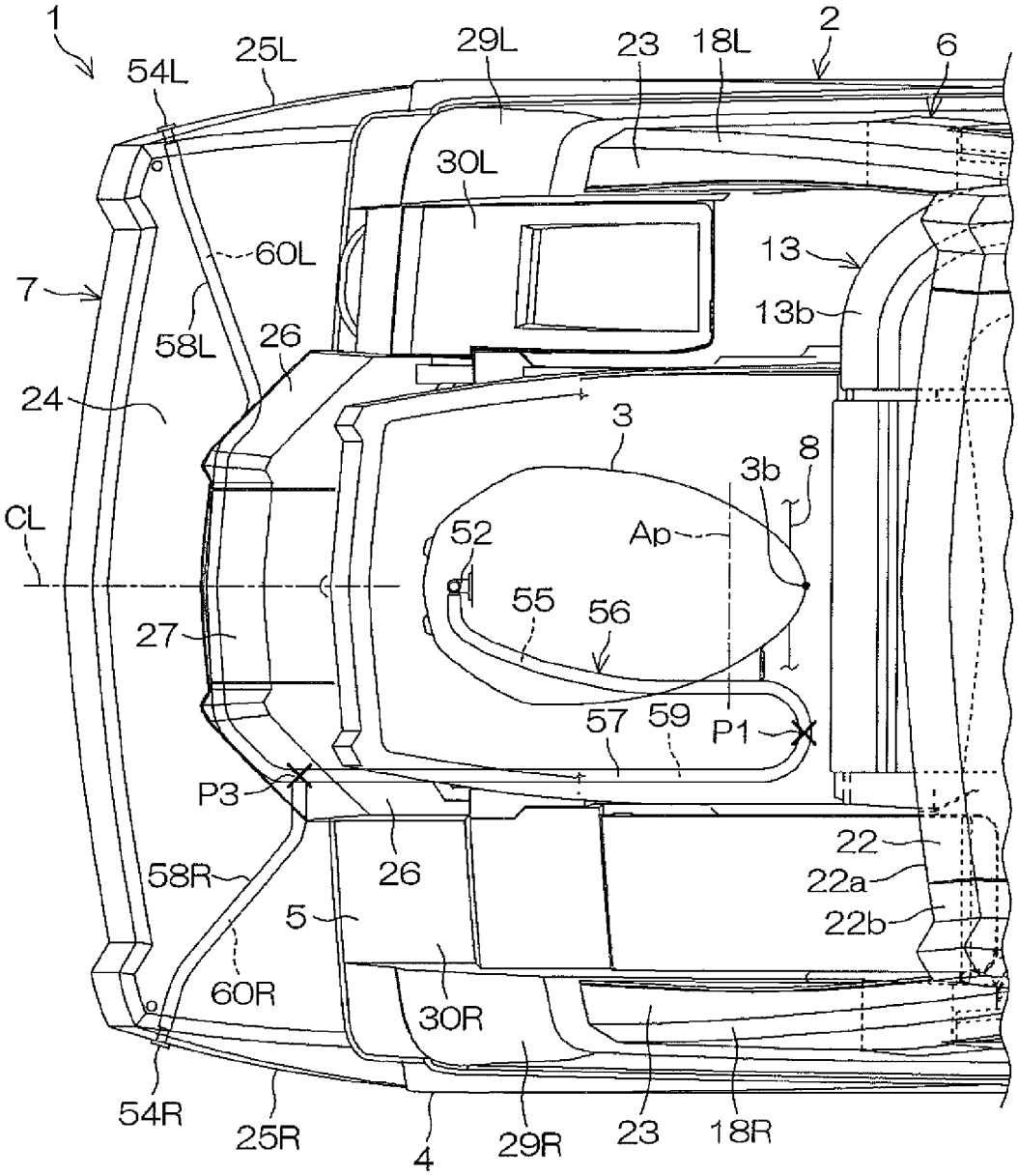
FIG. 8 is a transparent view of the rear portion of the vessel as viewed from above.
Figure 9:
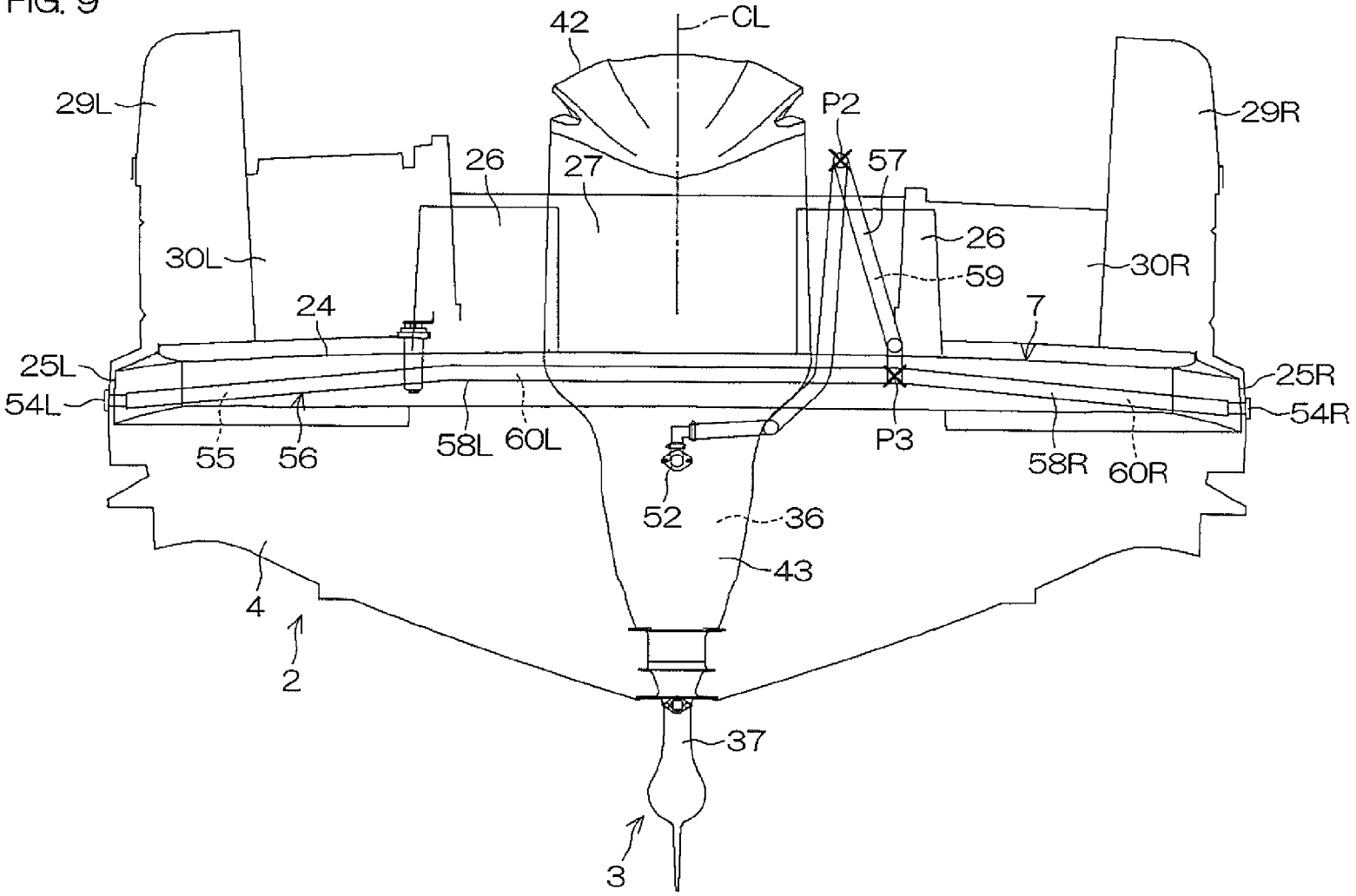
FIG. 9 is a transparent view of the vessel as viewed from the rear.

FIG. 7 is a transparent view of a rear portion of the vessel 1 as viewed from the right. FIG. 8 is a transparent view of the rear portion of the vessel 1 as viewed from above. FIG. 9 is a transparent view of the vessel 1 as viewed from the rear. The platform 7 and the bed 15 are disposed above the exhaust hose 56 and in FIG. 7 to FIG. 9, the exhaust hose 56 is indicated by solid lines.

As shown in FIG. 8, the vessel 1 includes downstream exhaust ports 54 (a right downstream exhaust port 54R and a left downstream exhaust port 54L) that are disposed farther to the lateral sides than the outboard motor 3 and the exhaust hose 56 that defines an exhaust passage 55 by which the exhaust emitted from the outboard motor 3 is guided to each of the right downstream exhaust port 54R and the left downstream exhaust port 54L.

As shown in FIG. 8, the right downstream exhaust port 54R and the left downstream exhaust port 54L are respectively disposed at the right side surface 25R and the left side surface 25L of the platform 7. The right downstream exhaust port 54R and the left downstream exhaust port 54L are thus disposed respectively at the right side surface and the left side surface of the body 2. Therefore, the right downstream exhaust port 54R is disposed at the right side of the width direction center CL of the body 2 and the left downstream exhaust port 54L is disposed at the left side of the width direction center CL of the body 2. As shown in FIG. 9, the right downstream exhaust port 54R and the left downstream exhaust port 54L are disposed higher than the upstream exhaust port 52 of the outboard motor 3 and open into the atmosphere.

As shown in FIG. 8, the right downstream exhaust port 54R and the left downstream exhaust port 54L are disposed at the platform 7 that extends rearward from the rear portion of the hull 4. The right side surface 25R and the left side surface 25L of the platform 7 are disposed farther to the lateral sides than the cabin 6. The right downstream exhaust port 54R and the left downstream exhaust port 54L are thus disposed farther to the lateral sides than the cabin 6. Further, the platform 7 is disposed farther to the rear than the outboard motor 3 and the cabin 6. The right downstream exhaust port 54R and the left downstream exhaust port 54L are thus disposed farther to the rear than the outboard motor 3 and the cabin 6. A front end 3*b* of the outboard motor 3 is disposed farther to the front than the right downstream exhaust port 54R and the left downstream exhaust port 54L.

As shown in FIG. 8, the exhaust hose 56 extends from the upstream exhaust port 52 of the outboard motor 3 to each of the right downstream exhaust port 54R and the left downstream exhaust port 54L. A flow passage length of the exhaust hose 56 (length along the exhaust hose 56) from the upstream exhaust port 52 to the right downstream exhaust port 54R is longer than a rectilinear distance from the upstream exhaust port 52 to the right downstream exhaust port 54R. Similarly, the flow passage length of the exhaust hose 56 from the upstream exhaust port 52 to the left downstream exhaust port 54L is longer than a rectilinear distance from the upstream exhaust port 52 to the left downstream exhaust port 54L.

As shown in FIG. 8, the exhaust hose 56 includes a collective hose 57 connected to the upstream exhaust port 52 of the outboard motor 3, a right branch hose 58R extending from the collective hose 57 to the right downstream exhaust port 54R, and a left branch hose 58L extending from the collective hose 57 to the left downstream exhaust port 54L. The collective hose 57 defines a collective passage 59 (a portion of the exhaust passage 55) connected to the upstream exhaust port 52. The right branch hose 58R defines a right branch passage 60R (a portion of the exhaust passage 55) extending from the collective passage 59 to the right downstream exhaust port 54R and the left branch hose 58L defines a left branch passage 60L (a portion of the exhaust passage 55) extending from the collective passage 59 to the left downstream exhaust port 54L.

As shown in FIG. 8, the collective hose 57 is disposed at a periphery of the outboard motor 3. The collective hose 57 is disposed below the bed 15. The right branch hose 58R and the left branch hose 58L are disposed below the platform 7. An upstream end of the collective hose 57 is disposed in the interior of the outboard motor 3 (between the outer surface of the upper case 36 and the inner surface of the apron 43). A downstream end of the collective hose 57 is disposed below the platform 7. The upstream end of the right branch hose 58R and the upstream end of the left branch hose 58L are connected to the downstream end of the collective hose 57 at a connection position P3 below the platform 7. The right branch hose 58R extends from the downstream end of the collective hose 57 to the right downstream exhaust port 54R and the left branch hose 58L extends from the downstream end of the collective hose 57 to the left downstream exhaust port 54R.

As shown in FIG. 7, the collective hose 57 extends from the interior of the outboard motor 3 to the exterior of the outboard motor 3 through an opening 43*a* provided in the apron 43. As shown in FIG. 8, the collective hose 57 extends forward from the upstream exhaust port 52 of the outboard motor 3 to a fold-back position P1 farther to the front than the outboard motor 3 and the transom 8 and extends from the fold-back position P1 to the connection position P3 below the platform 7. The exhaust hose 56 extends from the upstream exhaust port 52 to a vicinity of the pivot axis Ap and extends from the vicinity of the pivot axis Ap to the downstream exhaust port 54. The exhaust hose 56 thus passes through the vicinity of the pivot axis Ap that does not change in position with respect to the hull 4 even when the outboard motor main body rotates around the pivot axis Ap.

As shown in FIG. 7, the collective hose 57 extends from the upstream exhaust port 52 of the outboard motor 3 to an uppermost position P2 higher than the right downstream exhaust port 54R and the left downstream exhaust port 54L and extends from the uppermost position P2 to the right downstream exhaust port 54R and the left downstream exhaust port 54L. The uppermost position P2 is, for example, a position that is farther downstream than the fold-back position P1 and is farther upstream than the connection position P3. The uppermost position P2 is, for example, a position that is higher than the upper surface 24 of the platform 7 and is lower than the upper surface of the outboard motor 3. Respective portions of the exhaust hose 56 from the upstream end to the uppermost position P2 are maintained in an upward inclined attitude so as to be positioned higher as the uppermost position P2 is approached, or in a horizontal attitude. Also, respective portions of the exhaust hose 56 from the uppermost position P2 to the downstream end are maintained in a downward inclined attitude so as to be positioned lower as the distance away from the uppermost position P2 increases, or in a horizontal attitude. The flow passage length of the exhaust hose 56 from the upstream end to the uppermost position P2 is shorter than the flow passage length of the exhaust hose 56 from the uppermost position P2 to the downstream end.

The exhaust emitted from the upstream exhaust port 52 of the outboard motor 3 into the exhaust hose 56 flows inside the collective hose 57 toward the connection position P3 of the collective hose 57, the right branch hose 58R, and the left branch hose 58L. The exhaust inside the collective hose 57 branches into two portions at the connection position P3 and flows into the right branch hose 58R and the left branch hose 58L. The exhaust inside the right branch hose 58R flows inside the right branch hose 58R toward the right downstream exhaust port 54R and is discharged obliquely rearward toward the right from the right downstream exhaust port 54R opening at the right side surface 25R of the platform 7. Similarly, the exhaust inside the left branch hose 58L flows inside the left branch hose 58L toward the left downstream exhaust port 54L and is discharged obliquely rearward toward the left from the left downstream exhaust port 54L opening at the left side surface 25L of the platform 7.

Figure 10:
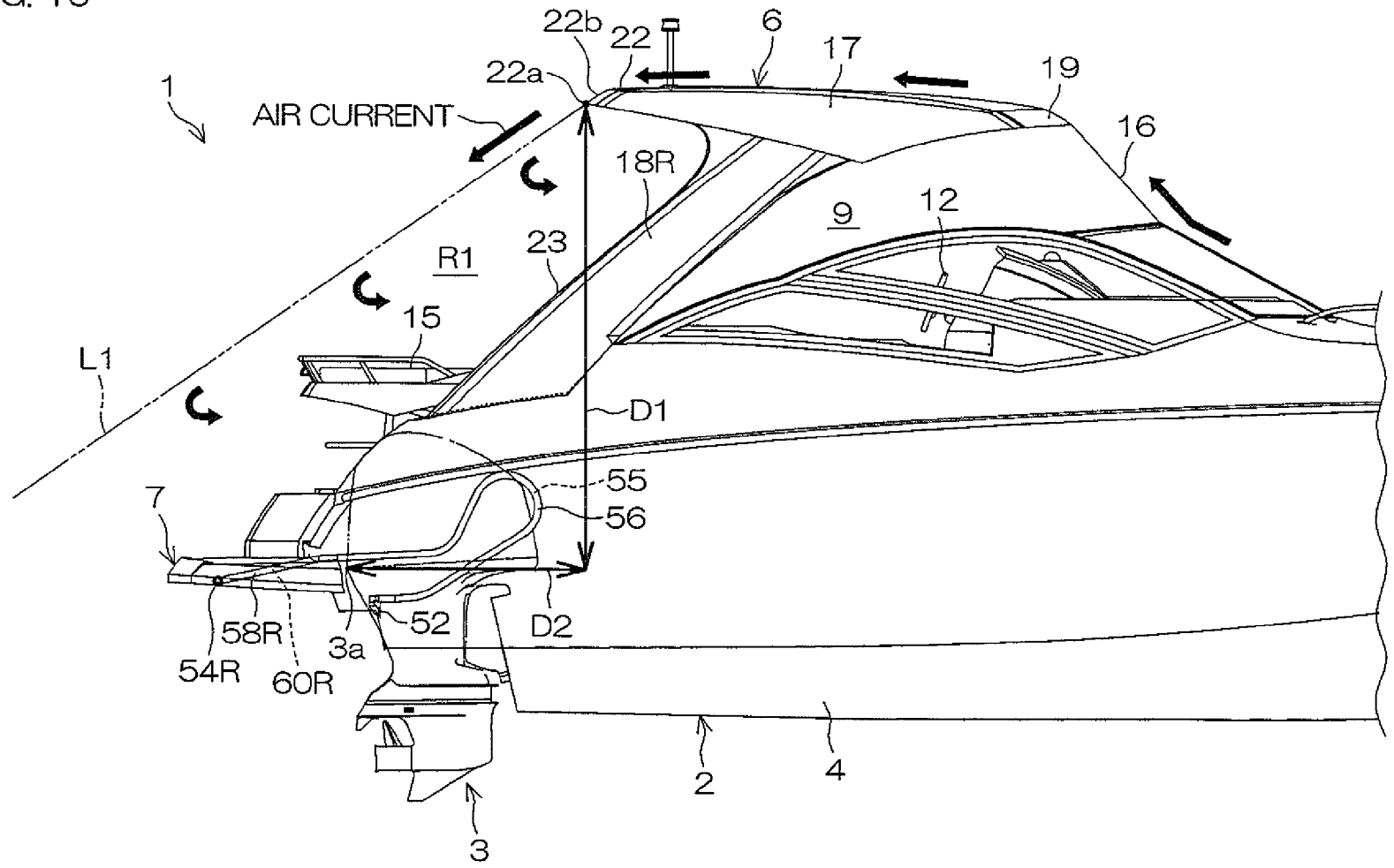
FIG. 10 is a schematic right side view of the vessel for describing a reverse flow of ambient air that arises in a space at the rear of a cabin.
Figure 11:
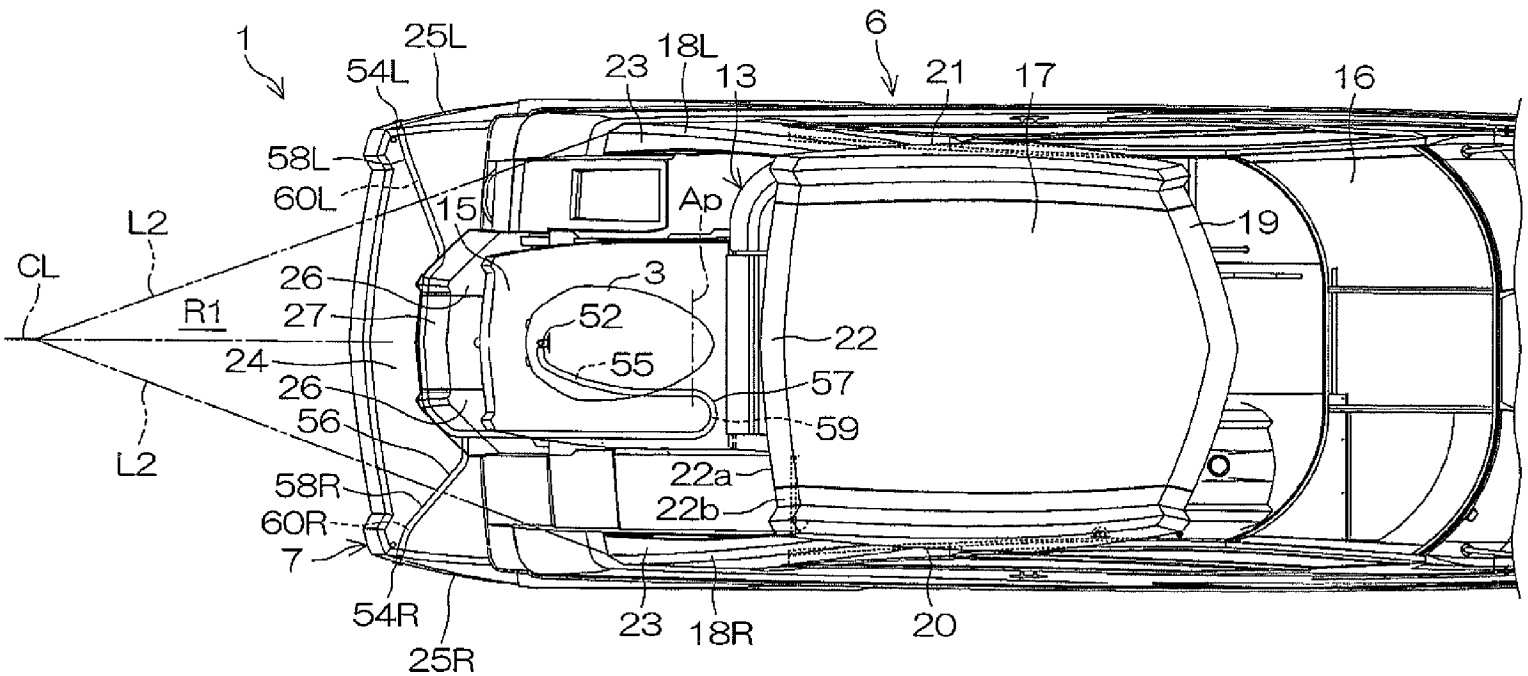
FIG. 11 is a schematic plan view of the vessel for describing a reverse flow of ambient air that arises in a space at the rear of the cabin.

FIG. 10 is a schematic right side view of the vessel 1 for describing a reverse flow of ambient air that arises in a space at the rear of the cabin 6. FIG. 11 is a schematic plan view of the vessel 1 for describing a reverse flow of ambient air that arises in a space at the rear of the cabin 6.

As shown in FIG. 10, an air current may flow rearward from the front of the vessel 1 when the vessel is stopped. The air current flowing rearward from the front of the cabin 6 flows obliquely upward and rearward along the front surface of the cabin front wall 16 and thereafter flows rearward along the upper surface of the cabin upper wall 17. The air current flowing rearward along the upper surface of the cabin upper wall 17 separates from the upper wall rear end edge 22*a* and flows farther rearward. Also, the air current flowing rearward from the front of the cabin 6 flows along the front surface of the cabin front wall 16 to at least one of the right and left sides and thereafter flows rearward along the side surface(s) of the cabin side wall(s) 18 (at least one of the right side surface of the right cabin side wall 18R and the left side surface of the left cabin side wall 18L). The air current flowing rearward along the side surface(s) of the cabin side wall (s) 18 separates from the side wall rear end edge (s) 23 and flows farther rearward.

As shown in FIG. 10, when the air current flowing rearward along the upper surface of the cabin upper wall 17 separates from the upper wall rear end edge 22*a* and flows farther rearward, a reverse flow region R1, in which an ambient atmosphere flows forward in reverse, may be formed in a space at the rear of the vessel 1. Similarly as shown in FIG. 11, when the air current flowing rearward along the side surface (s) of the cabin side wall (s) 18 separates from the side wall rear end edge (s) 23 and flows farther rearward, a reverse flow region R1 may be formed in a space at the rear of the vessel 1. The alternate long and two short dashes lines in FIG. 10 and FIG. 11 indicate boundary lines between a normal flow region (region in which a gas flows rearward) and the reverse flow region R1 when the direction of the rearwardly flowing air current is parallel or substantially parallel to the width direction center CL of the body 2.

As shown in FIG. 10, the boundary line L1 extends obliquely downward toward the rear from the upper wall rear end edge 22*a*. As shown in FIG. 11, the boundary lines L2 extend rearward toward the width direction center CL of the body 2 from the side wall rear end edges 23. The inclination angle of the boundary line L1 with respect to a horizontal plane is, for example, about 20 to about 30 degrees and preferably is approximately 25 degrees, for example. The inclination angle of the boundary line L1 with respect to the horizontal plane may change in accordance with the wind velocity and air flow rate. Similarly, the inclination angle of each boundary line L2 with respect to a vertical plane may change in accordance with the wind velocity and air flow rate.

Since the direction of the air current in FIG. 11 is parallel or substantially parallel to the width direction center CL of the body 2, the two boundary lines L2 are preferably right/left symmetrical with respect to the width direction center CL of the body 2. However, if the air current direction is inclined with respect to the width direction center CL of the body 2, the inclinations of the two boundary lines L2 will also change. For example, when an air current flows from obliquely forward right of the vessel 1 to obliquely rearward left of the vessel 1, the inclination angle of the left boundary line L2 with respect to the vertical plane decreases and the inclination angle of the right boundary line L1 with respect to the vertical plane increases. That is, the intersection of the two boundary lines L2 becomes biased to the left side with respect to the width direction center CL of the body 2.

As shown in FIG. 10, the area of the reverse flow region R1 in a side view increases as an upper separation position at which the air current separates from the cabin 6 is positioned higher. A distance D1 in the vertical direction from the rearmost end 3*a* of the outboard motor 3 to the upper wall rear end edge 22*a* of the cabin upper wall 17 is preferably not less than ½ or about ½ of a horizontal distance D2 in the front/rear direction from the rearmost end 3*a* of the outboard motor 3 to the upper wall rear end edge 22*a* of the cabin upper wall 17, for example. Also, a distance in the vertical direction from the upstream exhaust port 52 to the upper wall rear end edge 22*a* of the cabin upper wall 17 is preferably not less than ½ or about ½ of a horizontal distance in the front/rear direction from the upstream exhaust port 52 to the upper wall rear end edge 22*a* of the cabin upper wall 17, for example. Therefore, the position of the upper wall rear end edge 22*a* as the upper separation position is high and the area of the reverse flow region R1 in a side view is wide.

Also as shown in FIG. 11, the area of the reverse flow region R1 in a plan view increases as lateral separation positions, at each of which the air current separates from the cabin 6, are positioned farther to the lateral sides. That is, the area of the reverse flow region R1 in a plan view increases as the distance between the two lateral separation positions in the right/left direction increases. The right cabin side wall 18R and the left cabin side wall 18L extend upward from the right side wall 29R and the left side wall 29L of the hull 4. Therefore, the distance between the right cabin side wall 18R and the left cabin side wall 18L in the right/left direction is large and the width of the cabin 6 is wide. The distance between the two side wall rear end edges 23 as the lateral separation positions is thus large and the area of the reverse flow region R1 in a plan view is wide.

As shown in FIG. 10 and FIG. 11, the area of the reverse flow region R1 in a plan view is wide, the area of the reverse flow region R1 in a side view is wide, and therefore the reverse flow region R1 is large in volume. The outboard motor 3 is thus disposed inside the reverse flow region R1. The upstream exhaust port 52 provided in the outboard motor 3 is thus disposed inside the reverse flow region R1. Also, although being disposed below the boundary line L1, the right downstream exhaust port 54R and the left downstream exhaust port 54L are disposed at the lateral sides of the boundary lines L2. The right downstream exhaust port 54R and the left downstream exhaust port 54L are thus disposed outside the reverse flow region R1.

As shown in FIG. 11, the upstream exhaust port 52 disposed inside the reverse flow region R1 is connected by the exhaust hose 56 to the right downstream exhaust port 54R and the left downstream exhaust port 54L that are disposed outside the reverse flow region R1. The exhaust emitted from the upstream exhaust port 52 is guided by the exhaust hose 56 to the right downstream exhaust port 54R and the left downstream exhaust port 54L and is emitted from the right downstream exhaust port 54R and the left downstream exhaust port 54L. The exhaust emitted from the upstream exhaust port 52 is thus guided outside the reverse flow region R1 by the exhaust hose 56 and is emitted into the atmosphere from the right downstream exhaust port 54R and the left downstream exhaust port 54L. The amount of exhaust that enters into the interior of the cabin 6 due to reverse flow of air current is thus significantly reduced or prevented. Further, the right downstream exhaust port 54R and the left downstream exhaust port 54L discharge the exhaust in directions away from the reverse flow region R1 and it is thus unlikely for the exhaust emitted outside the reverse flow region R1 to return into the reverse flow region R1. The amount of exhaust entering into the interior of the cabin 6 is thus further significantly reduced or eliminated.

As described above, when an air current (crosswind) that is inclined in the horizontal direction with respect to the width direction center CL of the body 2 flows from the front of the vessel 1 toward the vessel 1, the inclination angles of the boundary lines L2 with respect to the vertical plane change. Therefore, when the inclination angle of the air current with respect to the width direction center CL of the body 2 is large, the right downstream exhaust port 54R or the left downstream exhaust port 54L may be disposed inside the reverse flow region R1. However, the right downstream exhaust port 54R and the left downstream exhaust port 54L are provided at the right side surface and the left side surface of the body 2, the distance between the right downstream exhaust port 54R and the left downstream exhaust port 54L in the right/left direction is thus large, and therefore even if one of the downstream exhaust ports 54 is disposed inside the reverse flow region R1, the other downstream exhaust port 54 will remain outside the reverse flow region R1. It is thus prevented that all of the exhaust is discharged into the reverse flow region R1. The concentration of exhaust inside the cabin 6 is thus significantly reduced even when the inclination angle of the air current with respect to the width direction center CL of the body 2 is large.

Figure 12A:
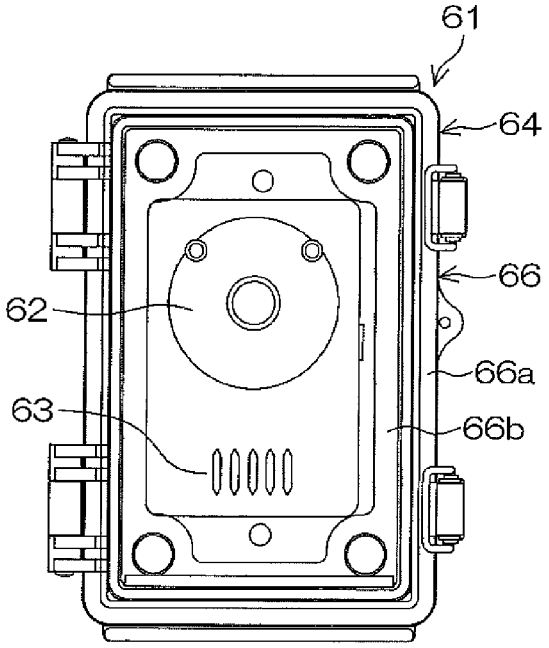
FIG. 12A is a front view of an exhaust concentration detector.
Figure 12B:
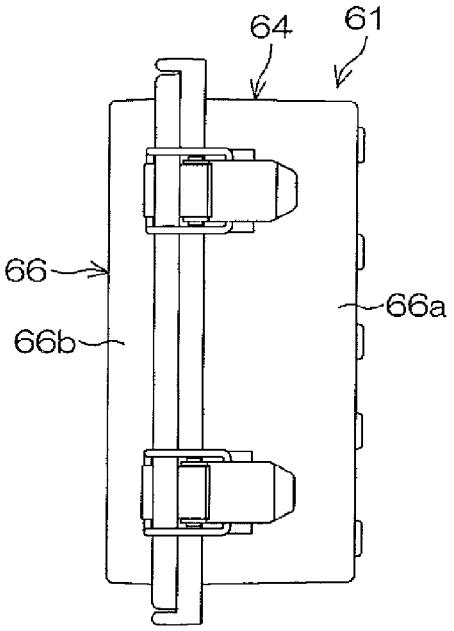
FIG. 12B is a left side view of the exhaust concentration detector.
Figure 12C:
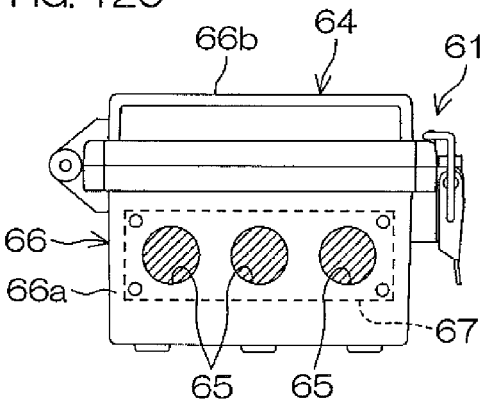
FIG. 12C is a bottom view of the exhaust concentration detector.

FIG. 12A, FIG. 12B, and FIG. 12C are diagrams of an exhaust concentration detector 61 that detects the concentration of exhaust inside the cabin 6. FIG. 12A is a front view of the exhaust concentration detector 61, FIG. 12B is a left side view of the exhaust concentration detector 61, and FIG. 12C is a bottom view of the exhaust concentration detector 61.

As shown in 12A, FIG. 12B, and FIG. 12C, the vessel 1 includes the exhaust concentration detector 61 that detects whether or not the concentration of exhaust inside the cabin 6 is not less than a warning concentration and notifies that the concentration of exhaust inside the cabin 6 is not less than the warning concentration when it is so. The exhaust concentration detector 61 is disposed inside the cabin 6 (see FIG. 2 and FIG. 3). The exhaust concentration detector 61 includes a concentration sensor 62 that detects the concentration of exhaust inside the cabin 6, an alarm unit 63 that provides a notification when the concentration of exhaust inside the cabin 6 is not less than the warning concentration, and a waterproof case 64 that houses the concentration sensor 62 and the alarm unit 63.

As shown in 12A, FIG. 12B, and FIG. 12C, the concentration sensor 62 and the alarm unit 63 preferably are, for example, an integral unit. The concentration sensor 62 and the alarm unit 63 are disposed in the interior of the waterproof case 64. The concentration sensor 62 is, for example, a sensor that detects the concentration of carbon monoxide inside the cabin 6. The alarm unit 63 is connected to the concentration sensor 62. The alarm unit 63 provides notification that the concentration of exhaust inside the cabin 6 is not less than the warning concentration by at least one of sound, light, characters, and figures.

As shown in 12A, FIG. 12B, and FIG. 12C, the waterproof case 64 includes a case main body 66, provided with one or more exhaust introduction ports 65 connecting the interior of the waterproof case 64 and the exterior of the waterproof case 64, and a waterproof gas permeable membrane 67 that closes the exhaust introduction port(s) 65 provided in the case main body 66. The case main body 66 includes a box 66*a* that is open in front and a lid 66*b* that closes the opening of the box 66*a*. The box 66*a* houses the concentration sensor 62 and the alarm unit 63. A portion of the lid 66*b* is preferably made of a transparent material that makes the interior of the case main body 66 visible. Each exhaust introduction port 65 opens at the outer surface of the box 66*a*. The waterproof gas permeable membrane 67 is disposed inside the box 66*a* and closes each exhaust introduction port 65 from the inner side. The waterproof gas permeable membrane 67 includes a plurality of holes that prevent the permeation of liquid molecules and allow the permeation of gas molecules.

The interior of the cabin 6 is open rearward and therefore liquids, such as seawater, etc., and gases, such as exhaust, etc., flow into the interior of the cabin 6 from the rear of the cabin 6. Sprays of water may thus be dispersed toward the exhaust introduction port (s) 65. However, the entry of liquid into the exhaust concentration detector 61 is prevented because each exhaust introduction port 65 is closed by the waterproof gas permeable membrane 67. An equipment fault due to contact with water or other liquid is thus prevented. On the other hand, the waterproof gas permeable membrane 67 allows gas to permeate and therefore the exhaust passes through the exhaust introduction port(s) 65 to enter inside the exhaust concentration detector 61 and arrive at the concentration sensor 62. The concentration of the exhaust inside the cabin 6 is thus detected.

Seawater or dirty water may enter into the interior of the cabin 6 and there is thus a possibility for the pores of the waterproof gas permeable membrane 67 to become clogged due to soiling of the waterproof gas permeable membrane 67 by substances (for example, salt or debris) contained in the liquid. However, clogging of the waterproof gas permeable membrane 67 is resolved by washing of the waterproof gas permeable membrane 67, and the gas permeation performance of the waterproof gas permeable membrane 67 is thus recovered readily. In contrast, with an arrangement that provides waterproofness and gas permeability using a labyrinth structure, salt and other substances enter inside the narrow labyrinth and clogging of the labyrinth cannot be easily overcome. The maintenance properties of the exhaust concentration detector 61 are thus improved by use of the waterproof gas permeable membrane 67.

As described above, with the present preferred embodiment, the exhaust emitted from the upstream exhaust port 52 of the outboard motor 3 is guided by the exhaust passage 55 to the downstream exhaust ports 54 that are disposed farther to the lateral sides than the outboard motor 3. The exhaust emitted from the outboard motor 3 is thus discharged from the downstream exhaust ports 54. The cabin 6 has a high height and is disposed in front of the outboard motor 3. An air current that flows rearward from the front of the vessel 1 flows rearward along the cabin upper wall 17, functioning as the windshield, and flows farther rearward from the cabin upper wall 17. In this process, the ambient air at the periphery of the outboard motor 3 may flow in reverse toward the cabin 6. Therefore, by arranging the exhaust passage 55 to laterally guide the exhaust emitted from the outboard motor 3, the downstream exhaust ports 54 that emit the exhaust to the atmosphere is disposed outside the reverse flow region R1 in which the reverse flow of the ambient air occurs. Inflow of the exhaust into the cabin 6 is thus prevented and the comfort of the vessel occupants is improved.

Also with the present preferred embodiment, the downstream exhaust ports 54 are disposed farther to the lateral sides than the cabin upper wall 7 that functions as the windshield, and the positions of emission of the exhaust from the outboard motor 3 to the atmosphere (the positions of the downstream exhaust ports 54) are disposed farther away from the lateral sides of the outboard motor 3. The positions of emission of the exhaust to air are thus disposed farther away from the lateral sides from the reverse flow region R1 in which the reverse flow of the ambient air occurs. Therefore, even if the ambient air at the periphery of the outboard motor 3 flows in reverse toward the cabin 6, the inflow of the exhaust into the cabin 6 is prevented.

Also with the present preferred embodiment, the operator seat 11 on which the operator sits preferably is disposed in the interior of the cabin 6 and the cabin 6 defines at least a portion of a cockpit. The exhaust emitted from the upstream exhaust port 52 of the outboard motor 3 is guided by the exhaust passage 55 to the downstream exhaust ports 54 disposed farther to the lateral sides than the outboard motor 3 and therefore even if the reverse flow of the ambient air occurs in the space at the rear of the cabin 6, the inflow of the exhaust into the cabin 6 is prevented. The comfort of the operator is thus improved.

Also with the present preferred embodiment, the exhaust passage 55 extends from the outboard motor 3 to each of the right downstream exhaust port 54R and the left downstream exhaust port 54L. The exhaust emitted from the outboard motor 3 is guided to each of the right downstream exhaust port 54R and the left downstream exhaust port 54L by the exhaust passage 55 and is discharged from each of the right downstream exhaust port 54R and the left downstream exhaust port 54L. The right downstream exhaust port 54R is disposed at the right side of the width direction center CL of the body 2 and the left downstream exhaust port 54L is disposed at the left side of the width direction center CL of the body 2. When an air current (crosswind) that flows rearwardly and laterally toward the vessel 1 is generated, a reverse flow region R1 may be formed so as to be biased to the right or the left with respect to the width direction center CL of the body 2. Therefore, by separating the right downstream exhaust port 54R and the left downstream exhaust port 54L in the right/left direction, it is thus prevented that both downstream exhaust ports 54 are disposed inside the reverse flow region R1 even when a crosswind flows. It is thus prevented that the exhaust discharged from both downstream exhaust ports 54 flows to the upper side of the body 2 and the degradation of comfort of the vessel occupant is prevented.

Also with the present preferred embodiment, the exhaust passage 55 is provided with the collective passage 59 connected to the outboard motor 3 and the two branch passages (the right branch passage 60R and the left branch passage 60L) branching from the collective passage 59. The exhaust inside the outboard motor 3 flows into the collective passage 59 and the exhaust inside the collective passage 59 flows into each of the right branch passage 60R and the left branch passage 60L. A portion of the exhaust passage 55 is thus branched and therefore the exhaust emitted from a position in common (the upstream exhaust port 52 of the outboard motor 3) is emitted from the right downstream exhaust port 54R and the left downstream exhaust port 54L that are separated in the right/left direction. It is thus prevented that the exhaust discharged from both downstream exhaust ports 54 flow to the upper side of the body 2 even when a crosswind flows.

Also with the present preferred embodiment, each of the right downstream exhaust port 54R and the left downstream exhaust port 54L is disposed farther to the rear than the front end 3*a* of the outboard motor 3 and is disposed to the rear away from the front end 3*a* of the outboard motor 3. The width (length in the right/left direction) of the reverse flow region R1, in which the reverse flow of the ambient air occurs, narrows as the rear end of the reverse flow region R1 is approached. Therefore, by not only disposing the right downstream exhaust port 54R and the left downstream exhaust port 54L at the right side and the left side of the width direction center CL but also disposing the right downstream exhaust port 54R and the left downstream exhaust port 54L farther to the rear, the positions at which the exhaust is emitted to the atmosphere air is disposed away from the reverse flow region R1. The reverse flow of the exhaust is thus prevented.

Also with the present preferred embodiment, the right downstream exhaust port 54R and the left downstream exhaust port 54L are provided at the platform 7 disposed farther to the rear than the outboard motor 3 and are disposed to the rear away from the outboard motor 3. The width (length in the right/left direction) of the reverse flow region R1, in which the reverse flow of the ambient air occurs, narrows as the rear end of the reverse flow region R1 is approached. The reverse flow of the exhaust is thus prevented by disposing the right downstream exhaust port 54R and the left downstream exhaust port 54L to the rear away from the outboard motor 3. The comfort of the vessel occupants is thus improved.

Also with the present preferred embodiment, the right downstream exhaust port 54R and the left downstream exhaust port 54L are provided respectively at the right side surface and the left side surface of the body 2 and the distance between the right downstream exhaust port 54R and the left downstream exhaust port 54L in the right/left direction is widened. It is prevented that both downstream exhaust ports 54 are disposed inside the reverse flow region R1 even when a crosswind flows. Further, the right downstream exhaust port 54R and the left downstream exhaust port 54L are disposed to the lateral sides away from the reverse flow region R1, it is thus prevented that one of the right downstream exhaust port 54R and the left downstream exhaust port 54L is disposed inside the reverse flow region R1. The reverse flow of exhaust is thus prevented effectively.

Also with the present preferred embodiment, the vessel 1 is provided with the exhaust hose 56 that defines the exhaust passage 55. The exhaust passage 55 is thus provided more simply than when the exhaust passage 55 is defined by the body 2. Further, the momentum of the exhaust is weakened as the exhaust flows through the interior of a long, narrow exhaust hose 56 and exhaust noise is thus reduced. The comfort of the vessel occupants is thus improved further.

Also with the present preferred embodiment, the exhaust hose 56 extends from the upstream exhaust port 52 of the outboard motor 3 to the uppermost position P2 higher than the upstream exhaust port 52 and the downstream exhaust ports 54 and the respective portions of the exhaust hose 56 from the upstream exhaust port 52 to the uppermost position P2 are maintained in the upward attitude or the horizontal attitude. The exhaust and liquid components contained therein that are discharged from the upstream exhaust port 52 rise with the discharged momentum to the uppermost position P2. Further, the exhaust hose 56 extends from the uppermost position P2 to the downstream exhaust ports 54 and the respective portions of the exhaust hose 56 from the uppermost position P2 to the downstream exhaust ports 54 are maintained in the downward attitude or the horizontal attitude. The liquid inside the exhaust hose 56 that has moved farther downstream from the uppermost position P2 is guided to the downstream exhaust ports 54 by the inclination of the exhaust hose 56. Water inside the exhaust hose 56 and ice formed by freezing of water inside the exhaust hose 56 is thus prevented from clogging the interior of the exhaust hose 56.

Also with the present preferred embodiment, the upstream exhaust port 52 provided in the outboard motor 3 extends upward toward the exterior of the outboard motor 3, and therefore the exhaust and the liquid components contained in the exhaust are discharged obliquely upward from the upstream exhaust port 52. The exhaust and liquid components discharged from the upstream exhaust port 52 move with the discharged momentum to positions farther downstream than the uppermost position P2. The exhaust and the liquid components contained therein are thus made to arrive reliably at positions farther downstream than the uppermost position P2. The clogging of the interior of the exhaust hose 56 by water or ice is thus prevented. The output of the engine 31 is thus prevented from decreasing.

Also with the present preferred embodiment, the exhaust hose 56 extends along a course passing through the upstream exhaust port 52 provided in the outboard motor 3, the fold-back position P1 farther to the front than the upstream exhaust port 52 and downstream exhaust ports 54, and the downstream exhaust ports 54 disposed farther to the lateral sides than the outboard motor 3, in that order. The exhaust hose 56 is thus longer than when the exhaust hose 56 extends along a rectilinear course joining the upstream exhaust port 52 and the downstream exhaust port 54. The momentum of the exhaust weakens as it flows through the long, narrow exhaust hose 56. If the exhaust hose 56 is long, the time during which the exhaust flows through the exhaust hose 56 increases. The momentum of the exhaust is thus weakened further and the exhaust noise is reduced. The comfort of the vessel occupants is thus improved.

Also with the present preferred embodiment, the exhaust hose 56 extends from the upstream exhaust port 52 to the vicinity of the pivot axis Ap and extends from the vicinity of the pivot axis Ap to the downstream exhaust ports 54. The exhaust hose 56 passes through the vicinity of the pivot axis Ap. Even when the outboard motor 3 is tilted up or down or is steered, the position of the pivot axis Ap with respect to the body 2 does not change. The respective portions of the exhaust hose 56 are thus disposed to have small movement amounts when the outboard motor 3 is tilted up or down or is steered. The exhaust hose 56 is thus prevented from twisting or tangling during a tilt operation of the outboard motor 3 or during a steering operation of the outboard motor 3.

Although preferred embodiments of the present invention have been described above, the present invention is not restricted to the contents of the preferred embodiments and various modifications are possible within the scope of the present invention.

Figure 13:
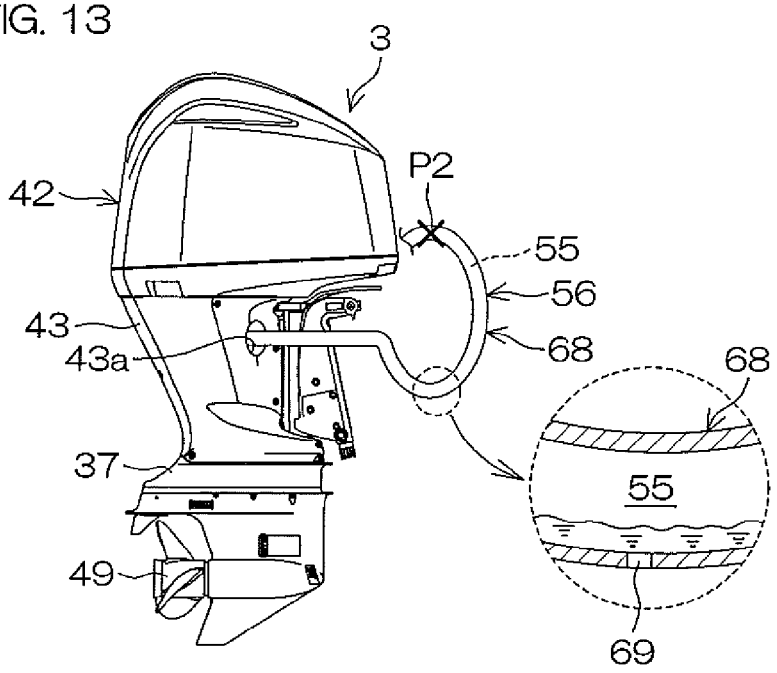
FIG. 13 is a schematic view of a modified example of an attitude of an exhaust hose.

For example, with the preferred embodiments described above, the case where the respective portions of the exhaust hose 56 from the upstream end to the uppermost position P2 are preferably maintained in the upward orientation or the horizontal orientation was described. However, a slack portion 68, which has a U-shaped or substantially U-shaped configuration which opens upwardly, may be provided between the upstream end and the uppermost position P2 as shown in FIG. 13. In this case, a drain port 69 configured to emit a liquid that stays in the slack portion 68 may be provided at a bottom portion of the slack portion 68. With this arrangement, water inside the exhaust hose 56 is emitted to the exterior of the exhaust hose 56 from the drain port 69 and clogging of the interior of the exhaust hose 56 by water or ice is thus prevented.

Also with the preferred embodiments described above, the case where the exhaust hose 56 preferably defines the exhaust passage 55 was described. However, the body 2 may define the exhaust passage 55 or the body 2 and the exhaust hose 56 may define the exhaust passage 55. In the case where at least a portion of the exhaust passage 55 is defined by the body 2, the strength of the exhaust passage 55 is increased in comparison to the case where at least a portion of the exhaust passage 55 is defined by the exhaust hose 56. The durability of the exhaust passage 55 is thus improved.

Figure 14:
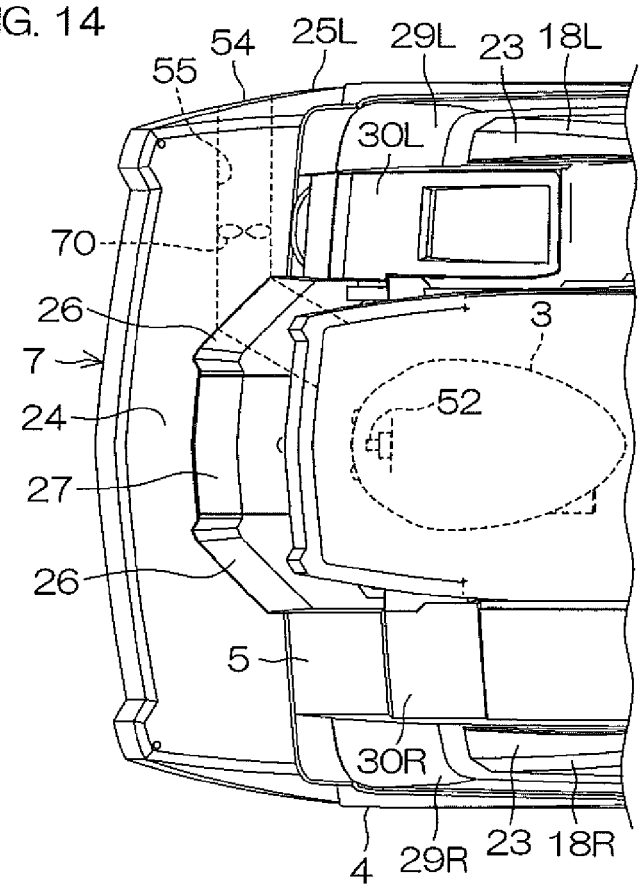
FIG. 14 is a plan view of a modified example in which an exhaust passage is defined by a body.

Also in the case where the body 2 defines at least a portion of the exhaust passage 55, a blower 70 that delivers gas inside the exhaust passage 55 to the downstream side may be disposed in the portion of the exhaust passage 55 defined by the body 2 as shown in FIG. 14. With this arrangement, the exhaust inside the exhaust passage 55 is reliably delivered to the downstream side by the blower 70, and the exhaust inside the exhaust passage 55 is thus emitted reliably and in a short time from at least one of the right downstream exhaust port 54R and the left downstream exhaust port 54L.

Also with the preferred embodiments described above, the case where the right side, the left side, and the rear side of the outboard motor 3 are preferably open above the water surface was described. However, the body 2 may cover the outboard motor 3 above the water surface from the front side, rear side, right side, left side, and upper side. That is, the body 2 may be provided with a sealed or substantially sealed space that houses the outboard motor 3 above the water surface. If the exhaust passage 55 is not provided in this arrangement, the exhaust emitted from the upstream exhaust port 52 may pass through a gap in the body 2 and move from the outboard motor 3 into the reverse flow region R1. The concentration of exhaust inside the cabin 6 is thus reduced when one of the preferred embodiments of the present invention is applied even to the body 2 with such an arrangement.

Also with the preferred embodiments described above, the case where the cabin 6 is preferably provided with the cabin upper wall 17 as the windshield was described. However, the cabin upper wall 17 may be omitted and the upper side of the cabin 6 may be open. The right cabin side wall 18R and the left cabin side wall 18L may also be omitted in addition to the cabin upper wall 17.

When the cabin upper wall 17 is omitted, an air current flowing rearward from the front of the vessel 1 flows rearward along the front surface of the cabin front wall 16, which serves as the windshield, and flows farther rearward from the upper end edge of the cabin front wall 16 as the upper separation position. In this process, the ambient air may flow forward in reverse in a space at the rear of the cabin front wall 16, and therefore by the exhaust emitted from the outboard motor 3 being guided by the exhaust passage 55 to positions farther to the lateral sides than the outboard motor 3, the reverse flow of the exhaust toward the front is prevented.

Also with the preferred embodiments described above, the case where the outboard motor 3 is preferably provided with a single upstream exhaust port 52 was described. However, the outboard motor 3 may be provided with two upstream exhaust ports 52, for example. In this case, the two upstream exhaust ports 52 may be connected respectively to the right downstream exhaust port 54R and the left downstream exhaust port 54L by two exhaust hoses 56, or the two upstream exhaust ports 52 may be connected to the right downstream exhaust port 54R and the left downstream exhaust port 54L by an exhaust hose 56 that is branched in two at both end portions.

Also with the preferred embodiments described above, the case where the upstream exhaust port 52 of the outboard motor 3 that opens above the water surface preferably extends upward toward the exterior of the outboard motor 3 was described. However, the upstream exhaust port 52 may extend horizontally or may extend downward toward the exterior of the outboard motor 3.

Also with the preferred embodiments described above, the case where the body 2 preferably includes the platform 7 was described. However, the platform 7 may be omitted and the rear side, right side, and left side of the outboard motor 3 may be open.

Also with the preferred embodiments described above, the case where the vessel 1 preferably includes a single outboard motor 3 was described. However, a plurality of outboard motors 3 may be mounted in a parallel state on a rear portion of the body 2.

The present application corresponds to Japanese Patent Application No. 2013-130797 filed on Jun. 21, 2013 in the Japan Patent Office, and the entire disclosure of this application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel comprising:

an outboard motor including an upstream exhaust port that emits exhaust;

a hull including a rear portion on which the outboard motor is mounted;

a cabin disposed above the hull and including a windshield disposed in front of the outboard motor in a plan view of the vessel, a height of the cabin from a rearmost end of the outboard motor being not less than about ½ of a horizontal distance in a front/rear direction from the rearmost end of the outboard motor to a rear end edge of the windshield;

a downstream exhaust port disposed farther to a lateral side of the vessel than the outboard motor; and an exhaust passage extending from the upstream exhaust port to the downstream exhaust port and configured to guide the exhaust from the upstream exhaust port to the downstream exhaust port; wherein the cabin, the outboard motor, and the windshield are configured and arranged with respect to each other to prevent an inflow of the exhaust into the cabin.

2. The vessel according to claim 1, wherein the downstream exhaust port is disposed farther to the lateral side of the vessel than the windshield of the cabin.

3. The vessel according to claim 1, further comprising an operator seat disposed in an interior of the cabin.

4. A vessel comprising:

an outboard motor including a crankshaft rotatable about a vertical axis;

a body including a rear portion on which the outboard motor is mounted so as to be rotatable around a pivot shaft extending horizontally in a width direction of the body;

a right downstream exhaust port disposed at a right side of a width direction center of the body;

a left downstream exhaust port disposed at a left side of the width direction center of the body; and at least one exhaust passage extending from the outboard motor to each of the right downstream exhaust port and the left downstream exhaust port and configured to guide exhaust from the outboard motor to each of the right downstream exhaust port and the left downstream exhaust port; wherein the at least one exhaust passage passes through a space above the pivot shaft.

5. The vessel according to claim 4, wherein the at least one exhaust passage includes a collective passage connected to the outboard motor, a right branch passage extending from the collective passage to the right downstream exhaust port, and a left branch passage extending from the collective passage to the left downstream exhaust port.

6. The vessel according to claim 4, wherein each of the right downstream exhaust port and the left downstream exhaust port is disposed farther to a rear of the vessel than a front end of the outboard motor.

7. The vessel according to claim 4, wherein the body includes a platform disposed farther to the rear of the vessel than the outboard motor, and each of the right downstream exhaust port and the left downstream exhaust port is located at the platform.

8. The vessel according to claim 4, wherein the right downstream exhaust port and the left downstream exhaust port are located respectively at a right side surface and a left side surface of the body.

9. The vessel according to claim 4, wherein at least a portion of the at least one exhaust passage is defined by an exhaust hose.

10. The vessel according to claim 4, wherein at least a portion of the at least one exhaust passage is defined by the body.

11. The vessel according to claim 10, further comprising a blower disposed inside the at least one exhaust passage and configured to deliver gas inside the at least one exhaust passage to at least one of the right downstream exhaust port and the left downstream exhaust port.

12. A vessel comprising:

an outboard motor including an upstream exhaust port that emits exhaust;

a body including a rear portion on which the outboard motor is mounted;

a downstream exhaust port disposed farther to a lateral side of the vessel than the outboard motor; and an exhaust hose configured to guide the exhaust from the upstream exhaust port to the downstream exhaust port, the exhaust hose extending in a horizontal attitude from the upstream exhaust port to an intermediate position between the upstream exhaust port and the downstream exhaust port, and extending in a downward attitude or a horizontal attitude from the intermediate position to the downstream exhaust port.

13. The vessel according to claim 12, wherein the upstream exhaust port extends upward toward an exterior of the outboard motor.

14. The vessel according to claim 12, wherein the exhaust hose extends from the upstream exhaust port to a fold-back position farther to a front of the vessel than the upstream exhaust port and the downstream exhaust port and extends rearward from the fold-back position to the downstream exhaust port.

15. The vessel according to claim 14, wherein the outboard motor is mounted on the rear portion of the body so as to be rotatable around a pivot axis extending horizontally in a width direction of the body, the pivot axis being disposed at a position farther to the front of the vessel than the upstream exhaust port and the downstream exhaust port; and the exhaust hose extends from the upstream exhaust port to a vicinity of the pivot axis and extends from the vicinity of the pivot axis to the downstream exhaust port.

16. A vessel comprising:

an outboard motor including an upstream exhaust port that emits exhaust;

a body including a rear portion on which the outboard motor is mounted;

a downstream exhaust port disposed farther to a lateral side of the vessel than the outboard motor; and an exhaust hose configured to guide the exhaust from the upstream exhaust port to the downstream exhaust port, the exhaust hose extending from the upstream exhaust port to an uppermost position higher than the upstream exhaust port and the downstream exhaust port, and extending from the uppermost position to the downstream exhaust port.

* * * * *